US010715915B2

(12) United States Patent
Seldess

(10) Patent No.: US 10,715,915 B2
(45) Date of Patent: Jul. 14, 2020

(54) SPATIAL CROSSTALK PROCESSING FOR STEREO SIGNAL

(71) Applicant: Boomcloud 360, Inc., Encinitas, CA (US)

(72) Inventor: Zachary Seldess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 68 days.

(21) Appl. No.: 16/147,296

(22) Filed: Sep. 28, 2018

(65) Prior Publication Data

US 2020/0107124 A1 Apr. 2, 2020

(51) Int. Cl.

| | |
|---|---|
| ***H04R 5/02*** | (2006.01) |
| ***H04R 3/12*** | (2006.01) |
| ***H04S 7/00*** | (2006.01) |
| ***H04S 1/00*** | (2006.01) |

(52) U.S. Cl.

CPC ..... *H04R 5/02* (2013.01); *H04R 3/12* (2013.01); *H04S 1/002* (2013.01); *H04S 7/302* (2013.01)

(58) Field of Classification Search

CPC ..... G10L 19/008; G10L 19/005; H04S 3/008; H04S 2400/11; H04S 2420/01; H04S 7/30

USPC ..... 381/310, 22; 700/94

See application file for complete search history.

(56) References Cited

U.S. PATENT DOCUMENTS

| | | | | |
|---|---|---|---|---|
| 10,299,056 | B2 * | 5/2019 | Walsh | H04S 3/02 |
| 2014/0355797 | A1 * | 12/2014 | North | H04S 5/00 381/307 |
| 2015/0172812 | A1 | 6/2015 | Wu | |
| 2017/0230772 | A1 * | 8/2017 | Johnson | H04S 1/002 |
| 2017/0230777 | A1 | 8/2017 | Seldess et al. | |

FOREIGN PATENT DOCUMENTS

WO WO 2017/127271 A1 7/2017

OTHER PUBLICATIONS

PCT International Search Report and Written Opinion, PCT Application No. PCT/US19/44547, dated Oct. 28, 2019, 20 pages.

* cited by examiner

*Primary Examiner* — Alexander Krzystan

(74) *Attorney, Agent, or Firm* — Fenwick & West LLP

(57) ABSTRACT

An audio system provides for crosstalk processing and crosstalk compensation processing of an audio signal. The crosstalk processing may include crosstalk cancellation processing or crosstalk simulation processing. A crosstalk processed signal is generated by applying the crosstalk processing to a side channel of the left and right channels, with a mid channel of the left and right channels bypassing the crosstalk processing. The crosstalk processed signal and the mid channel that bypasses crosstalk processing is used to generate a left output channel and a right output channel. In some embodiments, a crosstalk compensated signal is generated by applying crosstalk compensation processing to the side channel. The crosstalk compensated signal adjusts for spectral defects caused by the crosstalk processing. The crosstalk processing and crosstalk compensation processing may be applied in different orders. The left and right output channels are generated using the crosstalk processed signal and the crosstalk compensated signal.

19 Claims, 26 Drawing Sheets

800

SPATIAL CROSSTALK PROCESSING FOR STEREO SIGNAL

BACKGROUND

1. Field of the Disclosure

Embodiments of the present disclosure generally relate to the field of audio signal processing and, more particularly, to crosstalk processing of multi-channel audio.

2. Description of the Related Art

Crosstalk processing refers to processing of audio signals using contralateral and ipsilateral sound components, such as for crosstalk simulation or crosstalk cancellation. Crosstalk compensation refers to processing that adjusts for spectral defects caused by crosstalk processing. It is desirable to optimize the crosstalk processing and crosstalk compensation processing to increase computational speed and reduce computing resource usage.

SUMMARY

Embodiments relate to enhancing an audio signal including a left channel and a right channel. A crosstalk processing including at least one filter and a delay, such as crosstalk cancellation or crosstalk simulation, is applied to a side (or spatial) channel of the left and right channels to generate a crosstalk processed signal. The side channel includes a difference between the left channel and the right channel. A mid (or nonspatial) channel of the left and right channels bypasses the crosstalk processing. The mid channel includes a sum of the left and right channels. A left output channel and a right output channel is generated using the crosstalk processed signal and the mid channel that bypasses the crosstalk processing.

In some embodiments, crosstalk compensation processing is applied to the side channel to generate a crosstalk compensated signal to adjust for spectral defects caused by the crosstalk processing applied to the side channel. The mid channel bypasses the crosstalk compensation processing. The left and right output channels are generated using the crosstalk compensated signal, the crosstalk processed signal, and the mid channel that bypasses the crosstalk processing and crosstalk compensation.

Other aspects include components, devices, systems, improvements, methods, processes, applications, computer readable mediums, and other technologies related to any of the above.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

Example Crosstalk Compensation Processing

Embodiments relate to crosstalk processing, and in some embodiments crosstalk compensation processing, for stereo audio signals including left and right channels. The crosstalk processing may include crosstalk cancellation for loudspeakers, or crosstalk simulation for headphones. The crosstalk compensation processing adjusts for spectral defects resulting from the crosstalk processing. To increase processing efficiency, the crosstalk processing or crosstalk compensation processing is applied to a side channel generated from the left and right channels, while a mid channel generated from the left and right channels is bypassed. This may be achieved by generating the side channel, applying the crosstalk processing or crosstalk compensation to the side channel, and combining the processed side channel with the mid channel. In another example, crosstalk processing may be applied to each of the left and right channels, with the result being further processed such that the crosstalk processing is effectively applied to the side channel and bypasses the mid channel. The resulting output signal exhibits a spectrally transparent mid while retaining spatial crosstalk characteristics (e.g., either simulation for headphones or cancellation for loudspeakers).

Figure 1A:
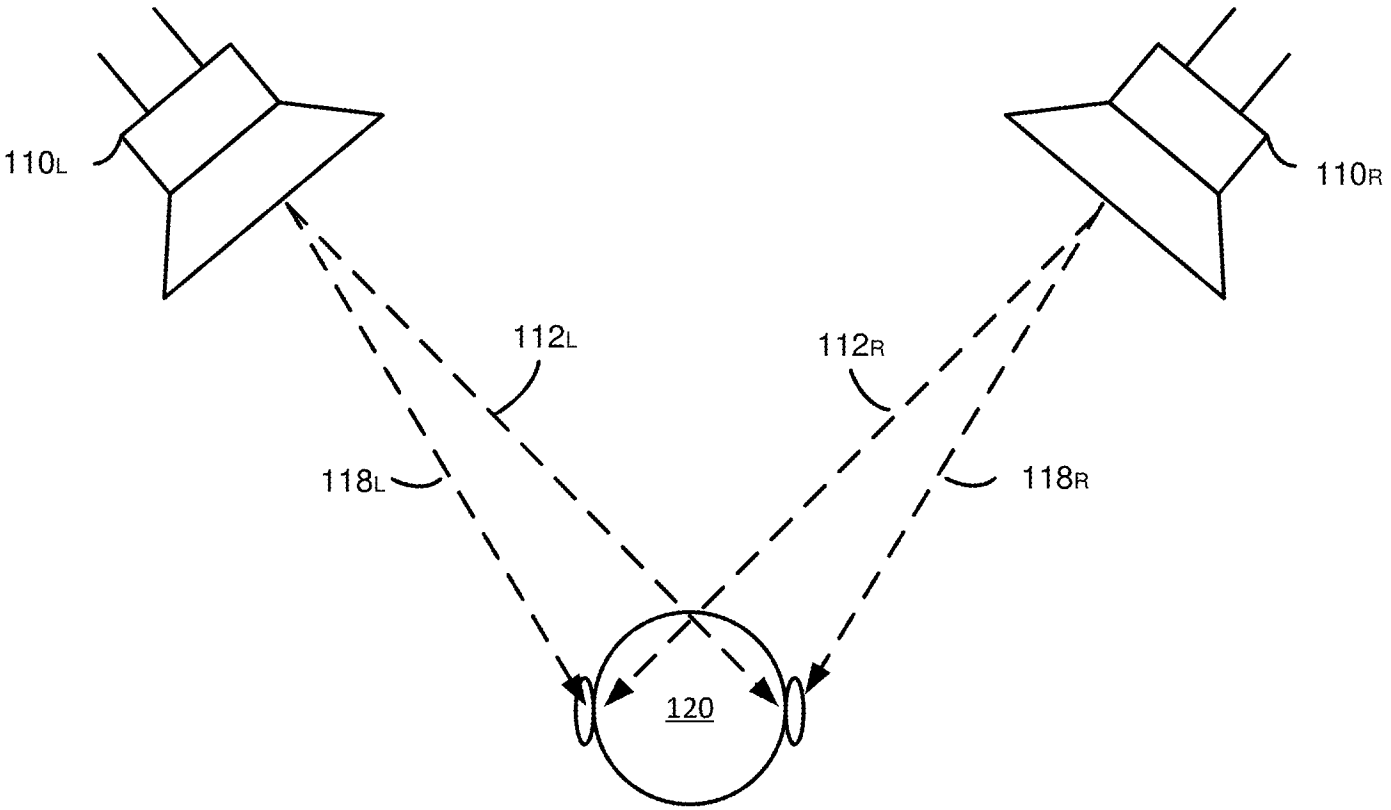
FIG. 1A illustrates an example of a stereo audio reproduction system for loudspeakers, according to one embodiment.

In a loudspeaker arrangement such as illustrated in FIG. 1A, sound waves produced by both of the loudspeakers $\mathbf{110}_L$ and $\mathbf{110}_R$ are received at both the left and right ears $\mathbf{125}_L$, $\mathbf{125}_R$ of the listener 120. The sound waves from each of the loudspeakers $\mathbf{110}_L$ and $\mathbf{110}_R$ have a slight delay between left ear $\mathbf{125}_L$ and right ear $\mathbf{125}_R$, and filtering caused by the head of the listener 120. A sound component (e.g., 118L, 118R) output by a speaker on the same side of the listener's head and received by the listener's ear on that side is herein referred to as "an ipsilateral sound component" (e.g., left channel signal component received at left ear, and right channel signal component received at right ear) and a sound component (e.g., 112L, 112R) output by a speaker on the opposite side of the listener's head is herein referred to as "a contralateral sound component" (e.g., left channel signal component received at right ear, and right channel signal component received at left ear). Contralateral sound components contribute to crosstalk interference, which results in diminished perception of spatiality. Thus, a crosstalk cancellation may be applied to the audio signals input to the loudspeakers 110 to reduce the experience of crosstalk interference by the listener 120.

Figure 1B:
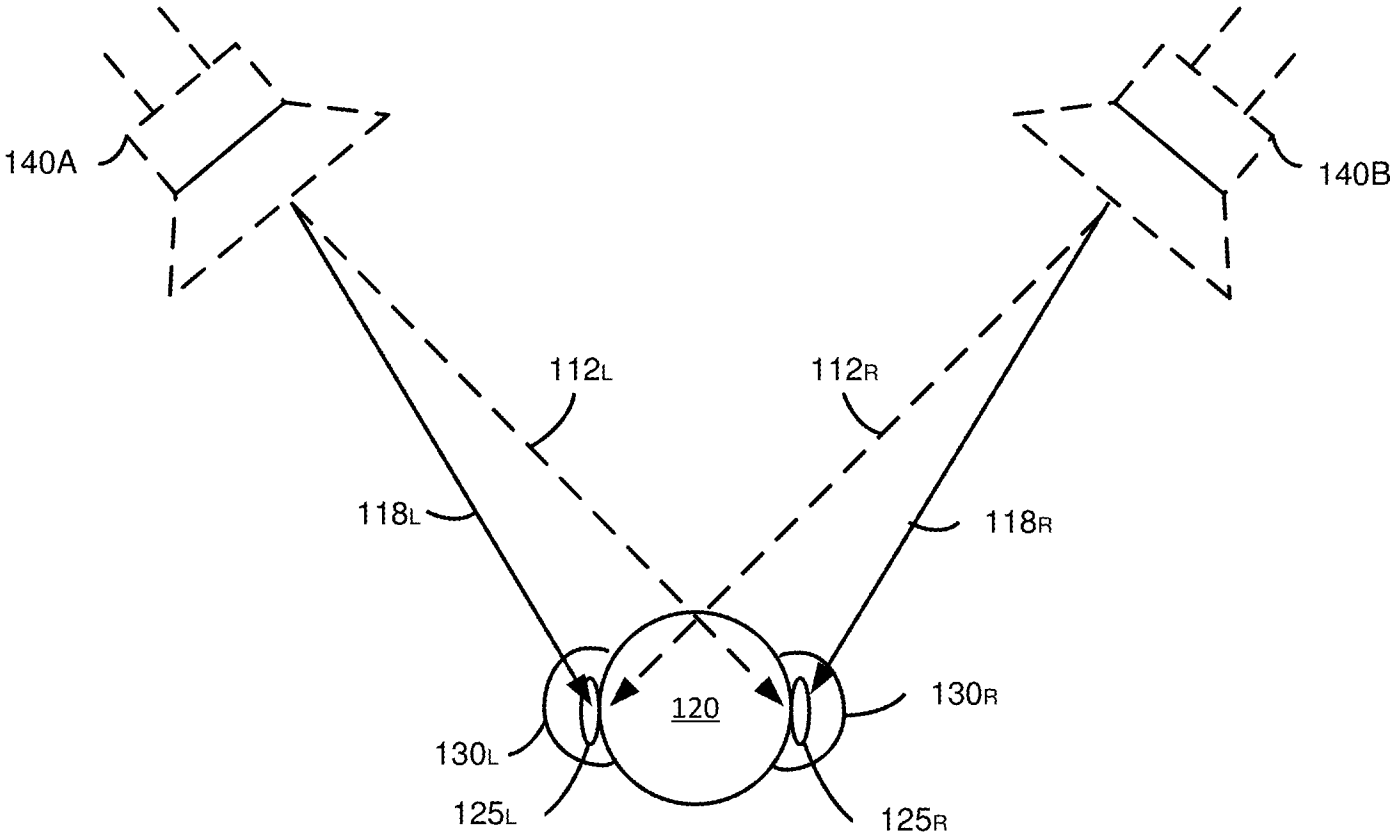
FIG. 1B illustrates an example of a stereo audio reproduction system for headphones, according to one embodiment.

In a head-mounted speaker arrangement such as illustrated in FIG. 1B, a dedicated left speaker $\mathbf{130}_L$ emits sound into the left ear $\mathbf{125}_L$ and a dedicated right speaker $\mathbf{130}_R$ to emit sound into the right ear $\mathbf{125}_R$. Head-mounted speakers emit sound waves close to the user's ears, and therefore generate lower or no trans-aural sound wave propagation, and thus no contralateral components that cause crosstalk interference. Each ear of the listener 120 receives an ipsilateral sound component from a corresponding speaker, and no contralateral crosstalk sound component from the other speaker. Accordingly, the listener 120 will perceive a different, and typically smaller sound field with head-mounted speakers. Thus, a crosstalk simulation may be applied to the audio signals input to the head-mounted speakers 130 to simulate crosstalk interference as would be experienced by the listener 120 when the audio signals are output by imaginary loudspeaker sound sources 140A and 140B.

Example Audio Processing System

Figure 2A:
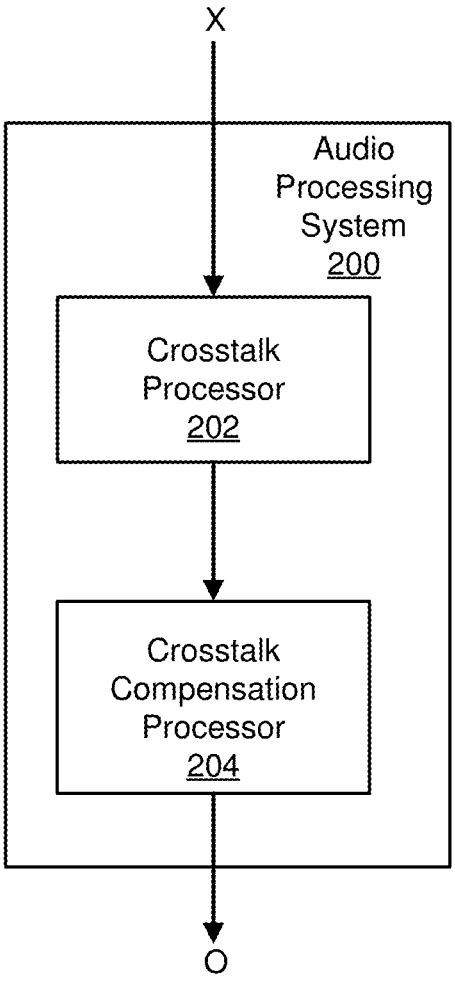
FIGS. 2A, 2B, and 2C each illustrates an example of an audio processing system for crosstalk processing, according to one embodiment.
Figure 2B:
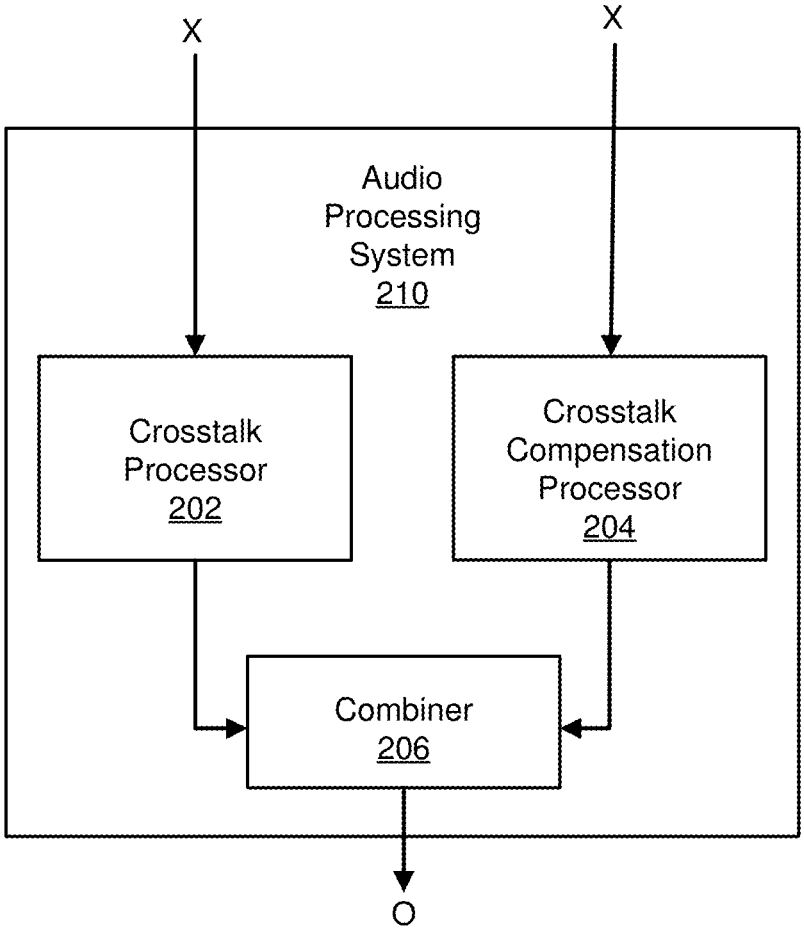
Figure 2C:
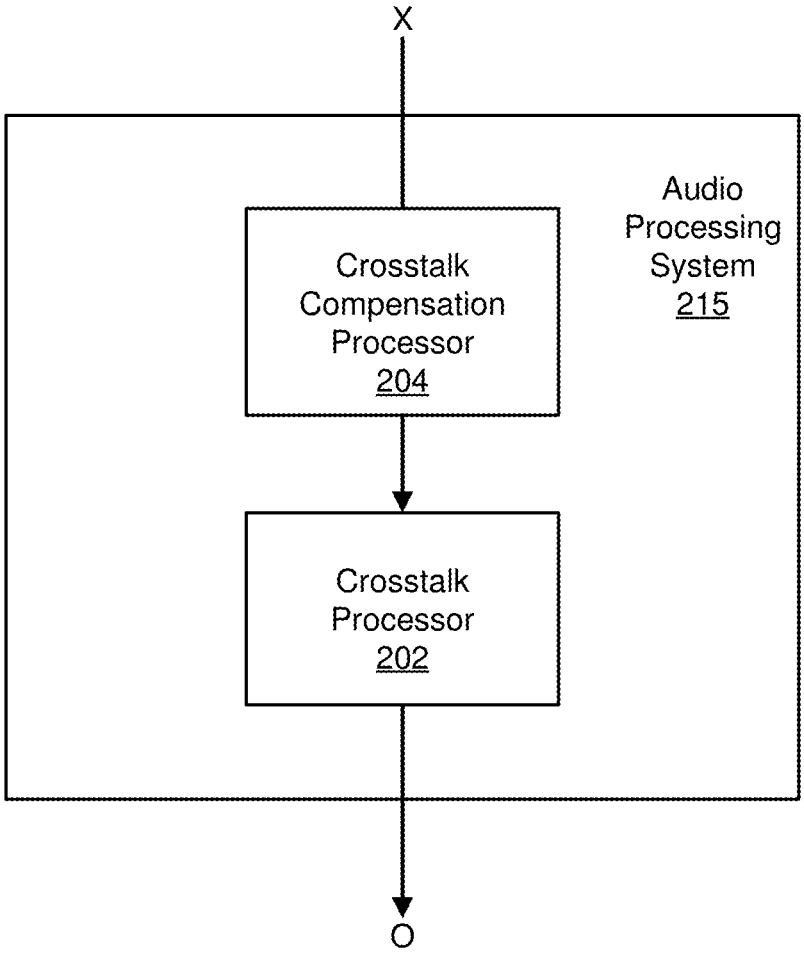

FIGS. 2A, 2B, and 2C each illustrates an example of an audio processing system for crosstalk processing, according to one embodiment. An audio processing system may perform the crosstalk processing, such as crosstalk cancellation or crosstalk simulation, and crosstalk compensation to adjust for spectral defects caused by the crosstalk processing in various orders. With reference to FIG. 2A, an audio processing system 200 includes a crosstalk processor 202 and a crosstalk compensation processor 204. The crosstalk processor 202 performs the crosstalk processing on an input audio signal X. The crosstalk compensation processor 204 is coupled to the crosstalk processor 202 to receive the result of the crosstalk processor 202. The crosstalk compensation processor 204 adjusts for spectral defects caused by the prior crosstalk processing to generate an output audio signal O. In some embodiments, the crosstalk compensation processor 204 may be omitted, or integrated with the crosstalk processor 202.

With reference to FIG. 2B, an audio processing system 210 includes the crosstalk processor 202, the crosstalk cancellation processor 204, and a combiner 206. Here, the crosstalk processor 202 and the crosstalk cancellation processor 204 receive the input audio signal X, and process the input audio signal X in parallel. The results from the crosstalk processor 202 and crosstalk compensation processor 204 are combined by the combiner 206 to generate the output audio signal O.

With reference to FIG. 2C, an audio processing system 215 includes the crosstalk compensation processor 204 and the crosstalk processor 202. The audio processing system 215 performs crosstalk processing and crosstalk compensation in series like the audio processing system 200, except in a different order. The crosstalk compensation processor 204 receives the input audio signal X, performs crosstalk compensation for spectral defects caused by subsequent crosstalk processing. The crosstalk processor 202 receives the result from the crosstalk compensation processor 204, and applies crosstalk processing to generate the output audio signal O.

Example Crosstalk Cancellation Processor

FIGS. 3A through 3F illustrate examples of crosstalk cancellation processors. A crosstalk cancellation processor reduces the experience of crosstalk interference when using the loudspeakers $\mathbf{110}_L$ and $\mathbf{110}_8$. Each of the crosstalk cancellation processors is an example of a crosstalk processor 202 of an audio processing system, such as those shown in FIGS. 2A through 2C.

Figure 3A:
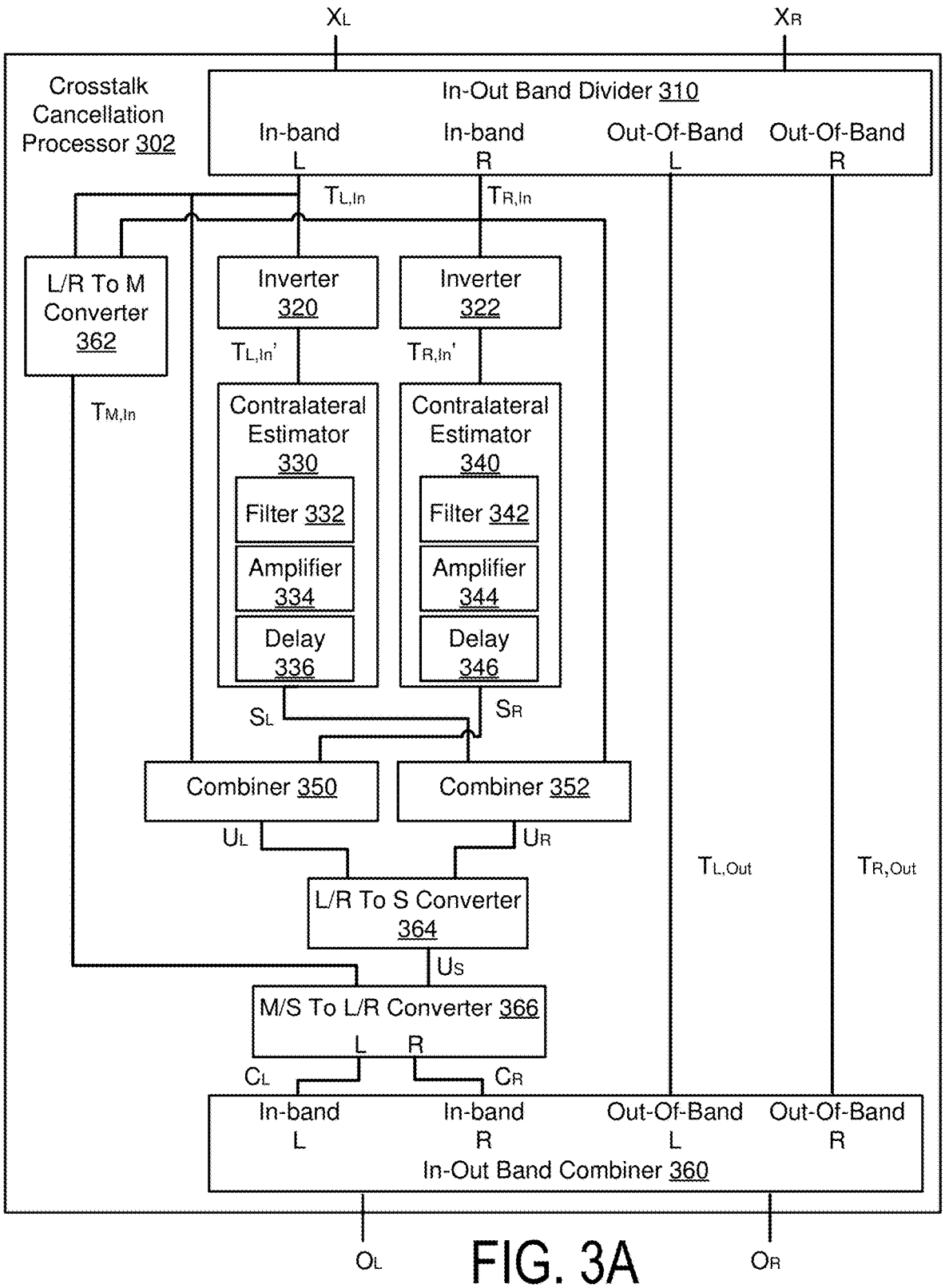
FIGS. 3A, 3B, 3C, 3D, 3E, and 3F each illustrates an example of a crosstalk cancellation processor, according to one embodiment.

FIG. 3A illustrates a crosstalk cancellation processor 302, according to one embodiment. The crosstalk cancellation processor 302 receives a left channel $X_L$ and a right channel $X_R$, and performs crosstalk cancellation on the channels $X_L$, $X_R$ to generate a left output channel $O_L$ and a right output channel $O_R$.

The crosstalk cancellation processor 302 includes an in-out band divider 310, inverters 320 and 322, contralateral estimators 330 and 340, combiners 350 and 352, an in-out band combiner 360, an L/R to M converter 362, an L/R to S converter 364, and an M/S to L/R converter 366. These components operate together to divide the input channels $T_L$, $T_R$ into in-band channels and out-of-band components, and perform a crosstalk cancellation on the in-band components to generate the output channels $O_L$, $O_R$.

By dividing the input audio signal T into different frequency band components and by performing crosstalk cancellation on selective components (e.g., in-band components), crosstalk cancellation can be performed for a particular frequency band while obviating degradations in other frequency bands. If crosstalk cancellation is performed without dividing the input audio signal T into different frequency bands, the audio signal after such crosstalk cancellation may exhibit significant attenuation or amplification in the nonspatial and spatial components in low frequency (e.g., below 350 Hz), higher frequency (e.g., above 12000 Hz), or both. By selectively performing crosstalk cancellation for the in-band (e.g., between 250 Hz and 14000 Hz), where the vast majority of impactful spatial cues reside, a balanced overall energy, particularly in the nonspatial component, across the spectrum in the mix can be retained.

The in-out band divider 310 separates the input channels $X_L$, $X_R$ into in-band channels $T_{L,In}$, $T_{R,In}$ and out-of-band channels $T_{L,Out}$, $T_{R,Out}$, respectively. Particularly, the in-out band divider 310 divides the left enhanced compensation channel $T_L$ into a left in-band channel $T_{L,In}$ and a left out-of-band channel $T_{L,Out}$. Similarly, the in-out band divider 310 separates the right enhanced compensation channel $T_R$ into a right in-band channel $T_{R,In}$ and a right out-of-band channel $T_{R,Out}$. Each in-band channel may encompass a portion of a respective input channel corresponding to a frequency range including, for example, 250 Hz to 14 kHz. The range of frequency bands may be adjustable, for example according to speaker parameters.

The inverter 320 and the contralateral estimator 330 operate together to generate a left contralateral cancellation channel $S_L$ to compensate for a contralateral sound component due to the left in-band channel $T_{L,In}$. Similarly, the inverter 322 and the contralateral estimator 340 operate together to generate a right contralateral cancellation channel $S_R$ to compensate for a contralateral sound component due to the right in-band channel $T_{R,In}$.

In one approach, the inverter 320 receives the in-band channel $T_{L,In}$ and inverts a polarity of the received in-band channel $T_{L,In}$ to generate an inverted in-band channel $T_{L,In}'$. The contralateral estimator 330 receives the inverted in-band channel $T_{L,In}'$, and extracts a portion of the inverted in-band channel $T_{L,In}'$ corresponding to a contralateral sound component through filtering. Because the filtering is performed on the inverted in-band channel $T_{L,In}'$, the portion extracted by the contralateral estimator 330 becomes an inverse of a portion of the in-band channel $T_{L,In}$ attributing to the contralateral sound component. Hence, the portion extracted by the contralateral estimator 330 becomes a left contralateral cancellation channel $S_L$, which can be added to a counterpart in-band channel $T_{R,In}$ to reduce the contralateral sound component due to the in-band channel $T_{L,In}$. In some embodiments, the inverter 320 and the contralateral estimator 330 are implemented in a different sequence.

The inverter 322 and the contralateral estimator 340 perform similar operations with respect to the in-band channel $T_{R,In}$ to generate the right contralateral cancellation channel $S_R$. Therefore, detailed description thereof is omitted herein for the sake of brevity.

In one example implementation, the contralateral estimator 330 includes a filter 332, an amplifier 334, and a delay unit 336. The filter 332 receives the inverted input channel $T_{L,In}'$ and extracts a portion of the inverted in-band channel $T_{L,In}'$ corresponding to a contralateral sound component through a filtering function. An example filter implementation is a Notch or Highshelf filter with a center frequency selected between 5000 and 10000 Hz, and Q selected between 0.5 and 1.0. Gain in decibels ($G_{dB}$) may be derived from Equation 1:

$$G_{dB}=-3.0-\log_{1.333}(D) \quad \text{Eq. (1)}$$

where D is a delay amount by delay unit 336 and 346 in samples, for example, at a sampling rate of 48 KHz. An alternate implementation is a Lowpass filter with a corner frequency selected between 5000 and 10000 Hz, and Q selected between 0.5 and 1.0. Moreover, the amplifier 334 amplifies the extracted portion by a corresponding gain coefficient $G_{L,In}$, and the delay unit 336 delays the amplified output from the amplifier 334 according to a delay function D to generate the left contralateral cancellation channel $S_L$.

The contralateral estimator 340 includes a filter 342, an amplifier 344, and a delay unit 346 that performs similar operations on the inverted in-band channel $T_{R,In}'$ to generate the right contralateral cancellation channel $S_R$. In one example, the contralateral estimators 330, 340 generate the left and right contralateral cancellation channels $S_L$, $S_R$, according to equations below:

$$S_L=D[G_{L,In}*F[T_{L,In}']] \quad \text{Eq. (2)}$$

$$S_R=D[G_{R,In}*F[T_{R,In}']] \quad \text{Eq. (3)}$$

where F[ ] is a filter function, and D[ ] is the delay function.

In some embodiments, a filter is integrated with an amplifier in a contralateral estimator. For example, the filter 332 may apply the gain of the amplifier 334 as part of a filtering function. In that sense, applying a filter to a signal or channel may include wideband adjustment of gain level in addition to adjustments based on frequency.

The configurations of the crosstalk cancellation can be determined by the speaker parameters. In one example, filter center frequency, delay amount, amplifier gain, and filter gain can be determined, according to an angle formed between two speakers with respect to a listener. In some embodiments, values between the speaker angles are used to interpolate other values.

The combiner 350 combines the right contralateral cancellation channel $S_R$ to the left in-band channel $T_{L,In}$ to generate a left in-band crosstalk channel $U_L$, and the combiner 352 combines the left contralateral cancellation channel $S_L$ to the right in-band channel $T_{R,In}$ to generate a right in-band crosstalk channel $U_R$.

The L/R to S converter 364 receives the left in-band crosstalk channel $U_L$ and the right in-band crosstalk channel $U_R$, and generates a side in-band crosstalk channel $U_S$. The side in-band crosstalk channel $U_S$ may be generated based on a difference between the left in-band crosstalk channel $U_L$ and the right in-band crosstalk channel $U_R$.

The L/R to M converter 362 receives the left in-band channel $T_{L,In}$ and the right in-band channel $T_{R,In}$, and generates a mid in-band channel $T_{M,In}$. The mid in-band channel $T_{M,In}$ may be generated based on a sum of the left in-band channel $T_{L,In}$ and the right in-band channel $T_{R,In}$.

The M/S to L/R converter 366 receives the mid in-band channel $T_{M,In}$ and the side in-band crosstalk channel $U_S$, and creates a left in-band crosstalk cancelled channel $C_L$ and a right in-band crosstalk cancelled channel $C_R$. The left crosstalk cancelled in-band channel $C_L$ may be generated based on a sum of the mid in-band channel $T_{M,In}$ and the side in-band crosstalk channel $U_S$, and the right in-band crosstalk cancelled channel $C_R$ may be generated based on a difference between the mid in-band channel $T_{M,In}$ and the side in-band crosstalk channel $U_S$. The side in-band channel $U_S$ is a side component of the left and right in-band crosstalk channels $U_L$, $U_R$, and is combined with mid in-band channel $T_{M,In}$, which is a mid component of the in-band channels $T_{L,In}$ and $T_{R,In}$.

The in-out band combiner 360 combines the left in-band channel $C_L$ with the out-of-band channel $T_{L,Out}$ to generate the left output channel $O_L$, and combines the right in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 302, and the right output channel $O_R$ is a right crosstalk cancelled channel of a crosstalk processed signal generated by the crosstalk cancellation processor 302. These crosstalk cancelled channels may be used as output of an audio processing system, or inputs to another component of the audio processing system (e.g., a crosstalk compensation processor 204 that adjusts for spectral defects caused by the crosstalk cancellation).

Accordingly, the left output channel $O_L$ includes the side component of the right contralateral cancellation channel $S_R$ corresponding to an inverse of a portion of the in-band channel $T_{R,In}$ attributing to the contralateral sound, and the right output channel $O_R$ includes the side component of the left contralateral cancellation channel $S_L$ corresponding to an inverse of a portion of the in-band channel $T_{L,In}$ attributing to the contralateral sound. In this configuration, a wavefront of an ipsilateral sound component output by the loudspeaker $\mathbf{110}_R$ according to the right output channel $O_R$ arrived at the right ear can cancel a wavefront of a contralateral sound component output by the loudspeaker $\mathbf{110}_L$ according to the left output channel $O_L$. Similarly, a wavefront of an ipsilateral sound component output by the speaker $\mathbf{110}_L$ according to the left output channel $O_L$ arrived at the left ear can cancel a wavefront of a contralateral sound component output by the loudspeaker $\mathbf{110}_R$ according to right output channel $O_R$. The left output channel $O_L$ is a left crosstalk cancelled channel of a crosstalk processed signal generated by the crosstalk cancellation processor 302, and the right output channel $O_R$ is a right crosstalk cancelled channel of a crosstalk processed signal generated by the crosstalk cancellation processor 302. Thus, contralateral sound components can be reduced to enhance spatial detectability.

Figure 3B:
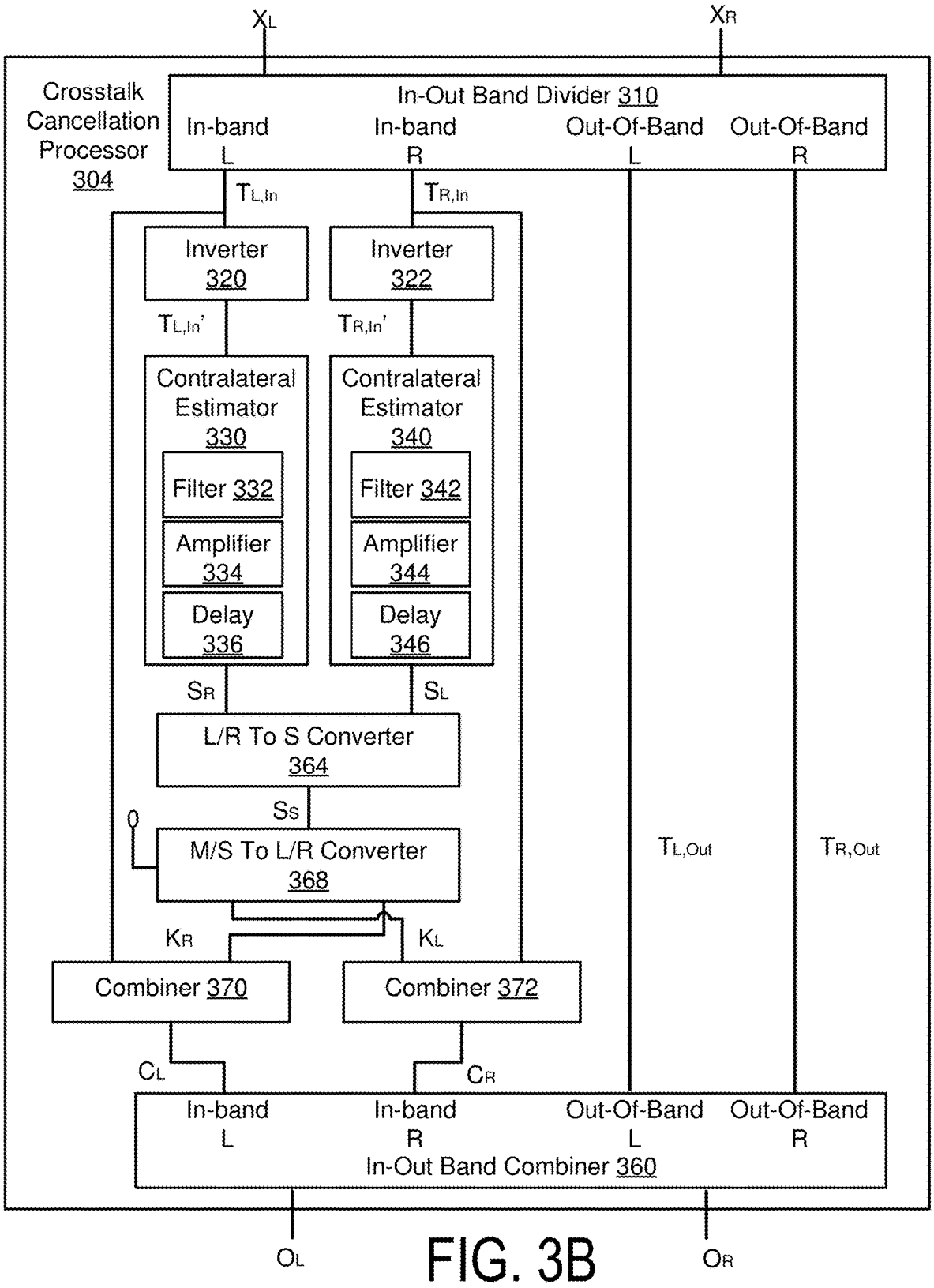

FIG. 3B illustrates a crosstalk cancellation processor 304, according to one embodiment. The crosstalk cancellation processor 304 is like the crosstalk cancellation processor 302, but includes improved processing efficiency. The crosstalk cancellation processor 304 includes the in-out band divider 310, the inverters 320 and 322, the contralateral estimaters 330 and 340, and the in-out band combiner 360. These components in the crosstalk cancellation processor 304 operate similarly to corresponding components in the crosstalk cancellation processor 302. The crosstalk cancellation processor 304 further includes an L/R to S converter 364 coupled to the contralateral estimators 330 and 340, an M/S to L/R converter 368 coupled to the L/R to S converter 364, and combiners 370 and 372 coupled to the S to L/R converter 368, the in-out band divider 310, and the in-out band combiner 360.

The L/R to S converter 364 receives the left contralateral cancellation channel $S_L$ and the right contralateral cancellation channel $S_R$, and generates a side contralateral cancellation channel $S_S$ based on a difference between the left contralateral cancellation channel $S_L$ and the right contralateral cancellation channel $S_R$.

The M/S to L/R converter 368 receives the side contralateral cancellation channel $S_S$ and a zero mid channel, and generates a left contralateral in-band channel $K_L$ and a right contralateral in-band channel $K_R$. The left contralateral in-band channel $K_L$ may be generated based on a sum of the side contralateral cancellation channel $S_S$ and the zero mid channel, and the right contralateral in-band channel $K_R$ may be generated based on a difference between the zero mid channel and the side contralateral cancellation channel $S_S$.

The combiner 370 receives the right contralateral in-band channel $K_R$ and the left in-band channel $T_{L,In}$, and generates the left crosstalk cancelled in-band channel $C_L$ by adding the right contralateral in-band channel $K_R$ and the left in-band channel $T_{L,In}$. The combiner 372 receives the left contralateral in-band channel $K_L$ and the right in-band channel $T_{R,In}$, and generates the right crosstalk cancelled in-band channel $C_R$ by adding the left contralateral in-band channel $K_L$ and the right in-band channel $T_{R,In}$.

The in-out band combiner 360 combines the left crosstalk cancelled in-band channel $C_L$ with the out-of-band channel $T_{L,Out}$ to generate the left output channel $O_L$, and combines the right crosstalk cancelled in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 304, and the right output channel $O_R$ is a right crosstalk cancelled channel of a crosstalk processed signal generated by the crosstalk cancellation processor 304.

Figure 3C:
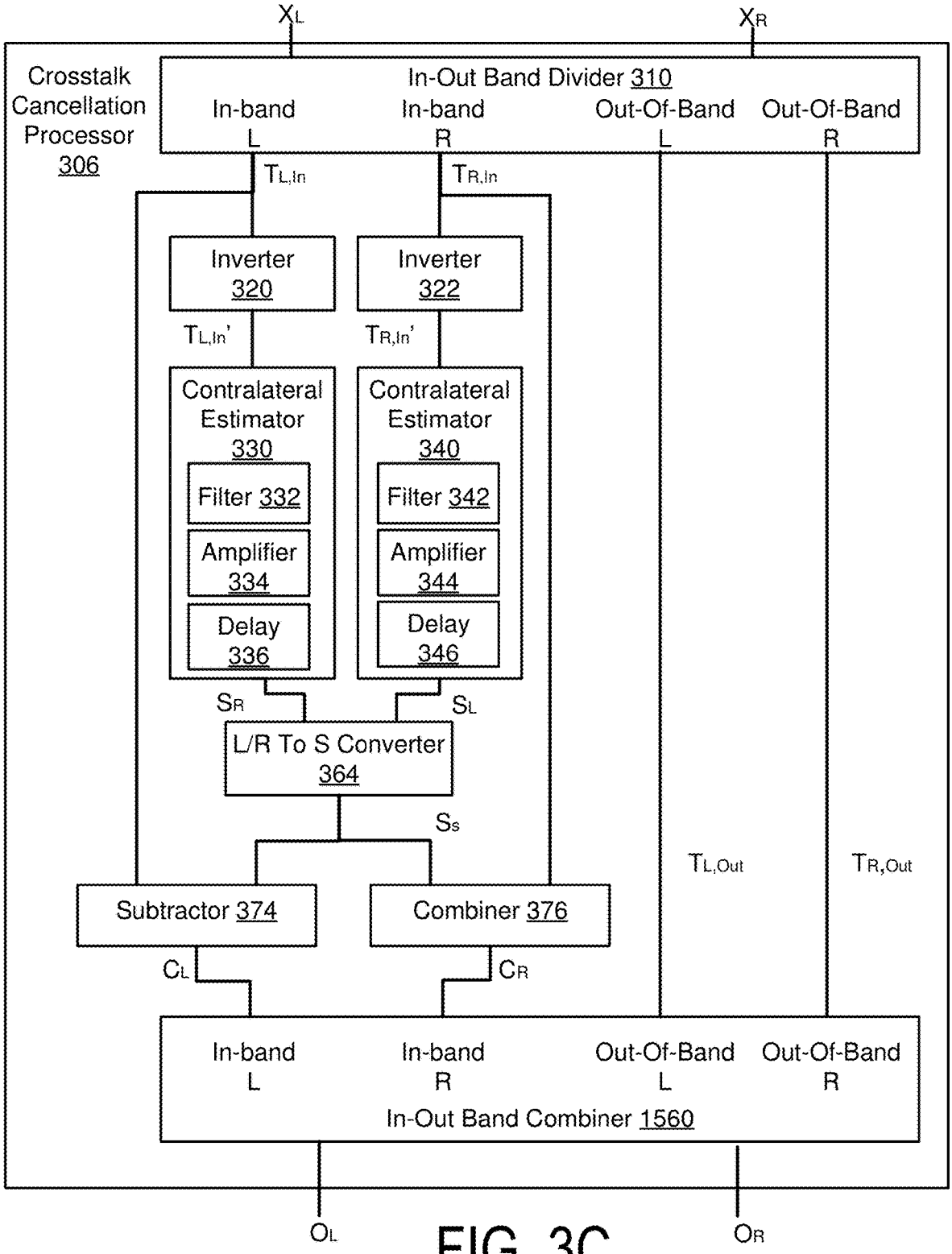

FIG. 3C illustrates a crosstalk cancellation processor 306, according to one embodiment. The crosstalk cancellation processor 306 is like the crosstalk cancellation processor 304, but includes improved processing efficiency. The crosstalk cancellation processor 306 includes the in-out band divider 310, the inverters 320 and 322, the contralateral estimaters 330 and 340, and the in-out band combiner 360. These components in the crosstalk cancellation processor 306 operate similarly to corresponding components in the crosstalk cancellation processor 302. The crosstalk cancellation processor 306 further includes an L/R to S converter 364 coupled to the contralateral estimators 330 and 340, and a subtractor 374 and a combiner 376 each coupled to the L/R to S converter 364, the in-out band divider 310, and the in-out band combiner 360.

The L/R to S converter 364 receives the left contralateral cancellation channel $S_L$ and the right contralateral cancellation channel $S_R$, and generates a side contralateral cancellation channel $S_S$ based on a difference between the left contralateral cancellation channel $S_L$ and the right contralateral cancellation channel $S_R$.

The subtractor 374 receives the left in-band channel $T_{L,In}$ and the side contralateral cancellation channel $S_S$, and generates the left crosstalk cancelled in-band channel $C_L$ based on a difference between the side contralateral cancellation channel $S_S$ and the left in-band channel $T_{L,In}$.

The combiner 376 receives the right in-band channel $T_{R,In}$ and the side contralateral cancellation channel $S_S$, and generates the right crosstalk cancelled in-band channel $C_R$ based on a sum of the side contralateral cancellation channel $S_S$ and the right in-band channel $T_{R,In}$.

The in-out band combiner 360 combines the left in-band channel $C_L$ with the out-of-band channel $T_{L,Out}$ to generate the left output channel $O_L$, and combines the right in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 306, and the right output channel $O_R$ is a right crosstalk cancelled channel of a crosstalk processed signal generated by the crosstalk cancellation processor 306.

A common goal of crosstalk cancellation is that of perceptually removing the crosschannel signal when listening to a symmetric loudspeaker system, where the overall crosschannel signals are transformed identically. That is, the left channel may be delayed, filtered, inverted, and scaled identically to the right channel before summing to the opposite channel. If we assume symmetry in the left/right crosschannel signal transformations, FIGS. 3D through 3F can illustrate examples of crosstalk cancellation processors with improved processing efficiency relative to the crosstalk cancellation processors shown in FIGS. 3A through 3C. In particular, crosstalk processing is applied to the side in-band channel $T_{S,In}$ generated from the left in-band channel $T_{L,In}$ and the right in-band channel $T_{R,In}$, while the mid in-band channel $T_{M,In}$ is not generated or otherwise bypasses the crosstalk processing that is applied to the side in-band channel $T_{S,In}$.

Figure 3D:
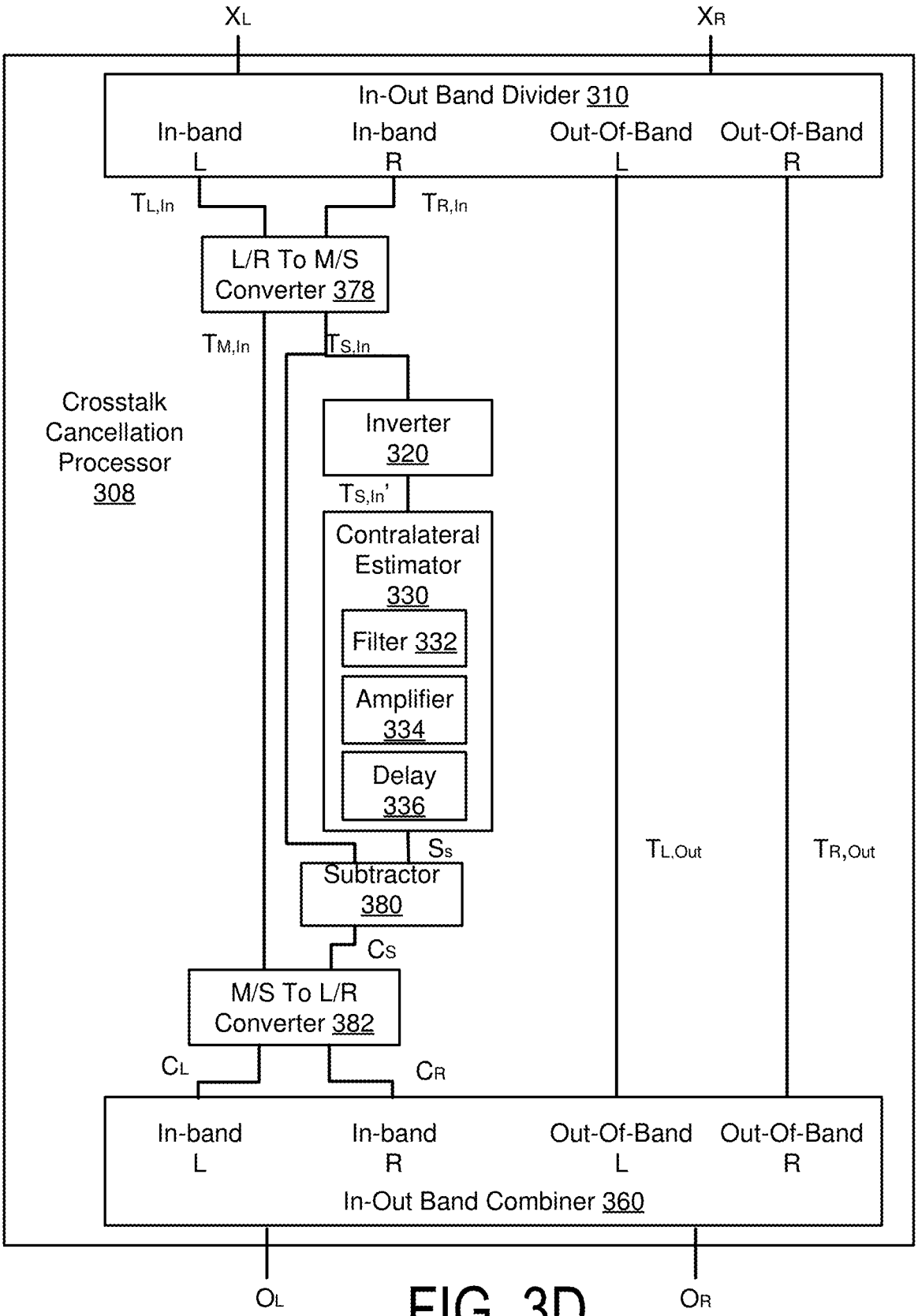

FIG. 3D illustrates a crosstalk cancellation processor 308, according to one embodiment. The crosstalk cancellation processor 308 includes an in-out band divider 310, an L/R to M/S converter 378, an inverter 320, a contralateral estimater 330, a subtractor 380, an M/S to L/R converter 382, and an in-out band combiner 360.

The in-out band divider 310 separates the input channels $X_L$, $X_R$ into the in-band channels $T_{L,In}$, $T_{R,In}$ and the out-of-band channels $T_{L,Out}$, $T_{R,Out}$, respectively. The L/R to M/S converter 378 is coupled to the in-out band divider 310 to receive the in-band channels $T_{L,In}$, $T_{R,In}$, and generates the side in-band channel $T_{S,In}$ and the mid in-band channel $T_{M,In}$. The side in-band channel $T_{S,In}$ may be generated based on a difference between the left in-band channel $T_{L,In}$ and the right in-band channel $T_{R,In}$. The mid in-band channel $T_{M,In}$ may be generated based on a sum of the left in-band channel $T_{L,In}$ and the right in-band channel $T_{R,In}$.

The inverter 320 and the contralateral estimator 330 operate together to generate a side contralateral cancellation channel $S_S$ from the side in-band channel $T_{S,In}$ to compensate for a contralateral sound component due to the mid in-band channel $T_{M,In}$. In particular, the inverter 320 receives the side in-band channel $T_{S,In}$ and inverts the polarity to generate an inverted side in-band channel $T_{S,In}'$. The contralateral estimator 330 receives the inverted side in-band channel $T_{S,In}'$, and extracts a portion of the inverted side in-band channel $T_{S,In}'$ corresponding to a contralateral sound component through filtering. Because the filtering is performed on the inverted side in-band channel $T_{S,In}'$, the portion extracted by the contralateral estimator 330 becomes an inverse of a portion of the side in-band channel $T_{S,In}$ attributing to the contralateral sound component. Hence, the portion extracted by the contralateral estimator 330 becomes the side contralateral cancellation channel $S_S$.

The subtractor 380 receives the side in-band channel $T_{S,In}$ and the side contralateral cancellation channel $S_S$, and generates a side crosstalk canceled in-band channel $C_S$ based on a difference between the side in-band channel $T_{S,In}$ and the side contralateral cancellation channel $S_S$. In some embodiments, the inverter 320 and the contralateral estimator 330 are implemented in a different sequence.

The M/S to L/R converter 382 receives the mid in-band channel $T_{M,In}$ and the side crosstalk canceled in-band channel $C_S$, and generates the left crosstalk canceled in-band channel $C_L$ and the right crosstalk canceled in-band channel $C_R$. For example, the left crosstalk canceled in-band channel $C_L$ may be generated based on a sum of the mid in-band channel $T_{M,In}$ and the side crosstalk canceled in-band channel $C_S$, and the right crosstalk canceled in-band channel $C_R$ may be generated based on a difference between the mid in-band channel $T_{M,In}$ and the side crosstalk canceled in-band channel $C_S$.

The in-out band combiner 360 combines the left crosstalk canceled in-band channel $C_L$ with the out-of-band channel $T_{L,Out}$ to generate the left output channel $O_L$, and combines the right crosstalk canceled in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 308, and the right output channel $O_R$ is a right crosstalk cancelled channel of a crosstalk processed signal generated by the crosstalk cancellation processor 308.

Figure 3E:
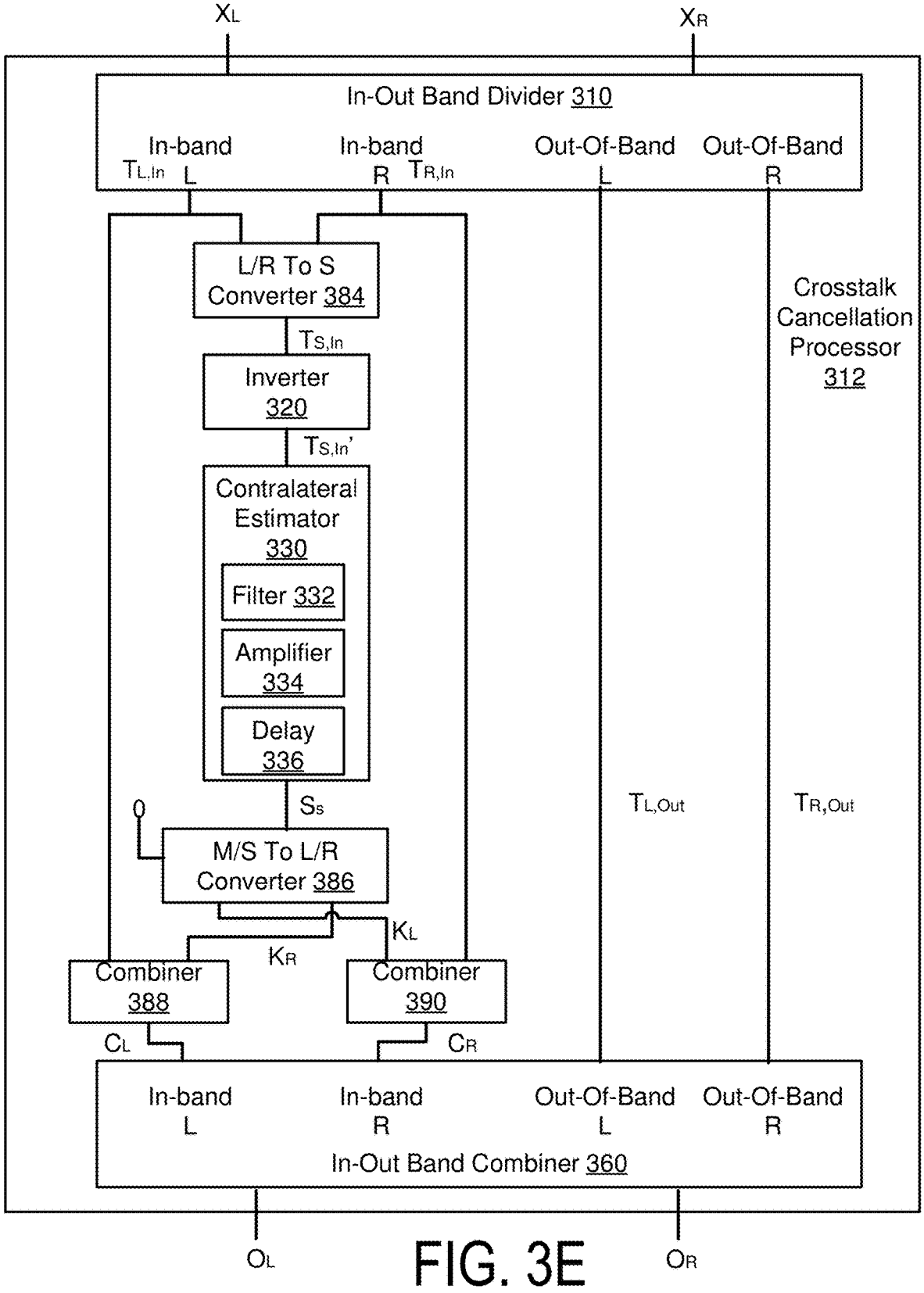

FIG. 3E illustrates a crosstalk cancellation processor 312, according to one embodiment. The crosstalk cancellation processor 312 is like the crosstalk cancellation processor 308, with similar processing efficiency. The crosstalk cancellation processor 312 includes the in-out band divider 310, the inverter 320, the contralateral estimater 330, and the in-out band combiner 360. These components in the crosstalk cancellation processor 312 operate similarly to corresponding components in the crosstalk cancellation processor 308.

The crosstalk cancellation processor 312 further includes an L/R to S converter 384 coupled to the in-out band divider 310 and the inverter 320, an M/S to L/R converter 386 coupled to the contralateral estimator 330, and combiners 388 and 390 coupled to the M/S to L/R converter 386, the in-out band divider 310, and the in-out band combiner 360. The L/R to S converter 384 receives the left in-band channel $T_{L,In}$ and the right in-band channel $T_{L,In}$, and generates a side in-band channel $T_{S,In}$ based on a difference between the left in-band channel $T_{L,In}$ and the right in-band channel $T_{L,In}$. The side in-band channel $T_{S,In}$ is processed by the inverter 320 and the contralateral estimator 330 to generate the side contralateral cancellation channel $S_S$. The M/S to L/R converter 386 receives the side contralateral cancellation channel $S_S$ from the contralateral estimator 330 and a zero mid channel, and generates a left contralateral in-band channel $K_L$ and a right contralateral in-band channel $K_R$. The left contralateral in-band channel $K_L$ may be generated based on a sum of the side contralateral cancellation channel $S_S$ and the zero mid channel, and the right contralateral in-band channel $K_R$ may be generated based on a difference between the zero mid channel and the side contralateral cancellation channel $S_S$.

The combiner 388 receives the right contralateral in-band channel $K_R$ and the left in-band channel $T_{L,In}$, and generates the left crosstalk cancelled in-band channel $C_L$ by adding the right contralateral in-band channel $K_R$ and the left in-band channel $T_{L,In}$. The combiner 390 receives the left contralateral in-band channel $K_L$ and the right in-band channel $T_{R,In}$, and generates the right crosstalk cancelled in-band channel $C_R$ by adding the left contralateral channel $K_L$ and the right in-band channel $T_{R,In}$.

The in-out band combiner 360 combines the left crosstalk cancelled in-band channel $C_L$ with the left out-of-band channel $T_{L,Out}$ to generate the left output channel $O_L$, and combines the right crosstalk cancelled in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 312, and the right output channel $O_R$ is a right crosstalk cancelled channel of a crosstalk processed signal generated by the crosstalk cancellation processor 312.

Figure 3F:
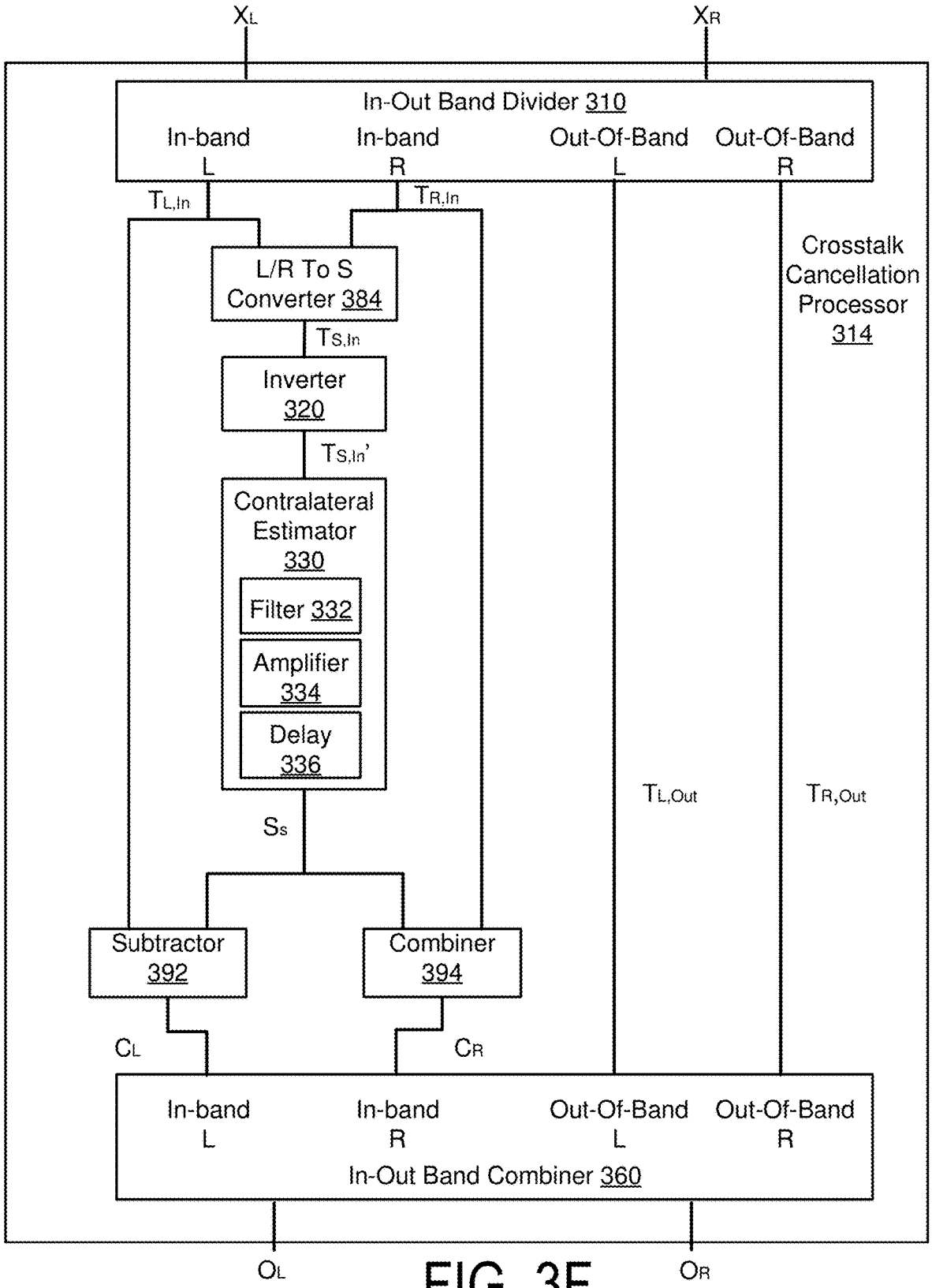

FIG. 3F illustrates a crosstalk cancellation processor 314, according to one embodiment. The crosstalk cancellation processor 314 is like the crosstalk cancellation processor 312, but includes improved processing efficiency. The crosstalk cancellation processor 314 includes the in-out band divider 310, the L/R to S converter 384, the inverter 320, the contralateral estimater 330, and the in-out band combiner 360. These components in the crosstalk cancellation processor 314 operate similarly to corresponding components in the crosstalk cancellation processor 312.

The crosstalk cancellation processor 312 further includes a subtractor 392 and a combiner 394, each coupled to the contralateral estimator 330, the in-out band divider 310, and the in-out band combiner 360. The subtractor 392 receives the left in-band channel $T_{L,In}$ from the in-out band divider 310 and the side contralateral cancellation channel $S_S$ from the contralateral estimator 330, and generates the left crosstalk cancelled in-band channel $C_L$ based on a difference between the left in-band channel $T_{L,In}$ and the side contralateral cancellation channel $S_S$. The combiner 394 receives the right in-band channel $T_{R,In}$ from the in-out band divider 310 and the side contralateral cancellation channel $S_S$ from the contralateral estimator 330, and generates the right crosstalk cancelled in-band channel $C_R$ based on a sum of the right in-band channel $T_{R,In}$ and the side contralateral cancellation channel $S_S$.

The in-out band combiner 360 combines the left crosstalk cancelled in-band channel $C_L$ with the left out-of-band channel $T_{L,Out}$ to generate the left output channel $O_L$, and combines the right crosstalk cancelled in-band channel $C_R$ with the out-of-band channel $T_{R,Out}$ to generate the right output channel $O_R$. The left output channel $O_L$ is a left crosstalk cancelled channel of a crosstalk processed signal generated by the crosstalk cancellation processor 314, and the right output channel $O_R$ is a right crosstalk cancelled channel of a crosstalk processed signal generated by the crosstalk cancellation processor 314.

The crosstalk cancellation processors shown in FIGS. 3A through 3F can produce equivalent output channels $O_L$, $O_R$ from the input channels $X_L$, $X_R$. Let A be a linear operation (e.g., filter) that encapsulates the functionality of a contralateral estimator 330 or 340. The output channels $O_L$ and $O_R$ for the crosstalk cancellation processor 302 shown in FIG. 3A may be defined by Equations 4 and 5, respectively:

$$O_L=\tfrac{1}{2}(X_L+X_R)+\tfrac{1}{2}((AX_R+X_L)-(AX_L+X_R)) \quad \text{Eq. (4)}$$

$$O_R=\tfrac{1}{2}(X_L+X_R)-\tfrac{1}{2}((AX_R+X_L)-(AX_L+X_R)) \quad \text{Eq. (5)}$$

The output channels $O_L$ and $O_R$ for the crosstalk cancellation processor 304 shown in FIG. 3B may be defined by Equations 6 and 7, respectively:

$$O_L=X_L+(0-\tfrac{1}{2}(AX_L-AX_R)) \quad \text{Eq. (6)}$$

$$O_R=X_R+(0+\tfrac{1}{2}(AX_L-AX_R)) \quad \text{Eq. (7)}$$

The output channels $O_L$ and $O_R$ for the crosstalk cancellation processor 306 shown in FIG. 3C may be defined by Equations 8 and 9, respectively:

$$O_L=X_L-\tfrac{1}{2}(AX_L-AX_R) \quad \text{Eq. (8)}$$

$$O_R=X_R+\tfrac{1}{2}(AX_L-AX_R) \quad \text{Eq. (9)}$$

The output channels $O_L$ and $O_R$ for the crosstalk cancellation processor 308 shown in FIG. 3D may be defined by Equations 10 and 11, respectively:

$$O_L=\tfrac{1}{2}(X_L+X_R)+(\tfrac{1}{2}(X_L-X_R)-\tfrac{1}{2}(AX_L-AX_R)) \quad \text{Eq. (10)}$$

$$O_R=\tfrac{1}{2}(X_L+X_R)-(\tfrac{1}{2}(X_L-X_R)+\tfrac{1}{2}(AX_L-AX_R)) \quad \text{Eq. (11)}$$

The output channels $O_L$ and $O_R$ for the crosstalk cancellation processor 312 shown in FIG. 3E may be defined by Equations 12 and 13, respectively:

$$O_L=X_L-\tfrac{1}{2}A(X_L-X_R) \quad \text{Eq. (12)}$$

$$O_R=X_R+\tfrac{1}{2}A(X_L-X_R) \quad \text{Eq. (13)}$$

The output channels $O_L$ and $O_R$ for the crosstalk cancellation processor 314 shown in FIG. 3F may be defined by Equations 14 and 15, respectively:

$$O_L=X_L-\tfrac{1}{2}(AX_L-AX_R) \quad \text{Eq. (14)}$$

$$O_R=X_R+\tfrac{1}{2}(AX_L-AX_R) \quad \text{Eq. (15)}$$

With algebraic manipulation, the Equations 4, 6, 8, 10, 12, and 14 for the left output channel $O_L$ are equivalent, and the Equations 5, 7, 9, 11, 13, and 14 for the right output channel $O_R$ are equivalent.

Example Crosstalk Simulation Processor

FIGS. 4A through 4F illustrate examples of crosstalk simulation processors. A crosstalk simulation processor provides a loudspeaker-like listening experience on the head-mounted speakers $\mathbf{130}_L$ and $\mathbf{130}_R$. Each of the crosstalk simulation processors is an example of a crosstalk processor 202 of an audio processing system shown in FIGS. 2A through 2C.

Figure 4A:
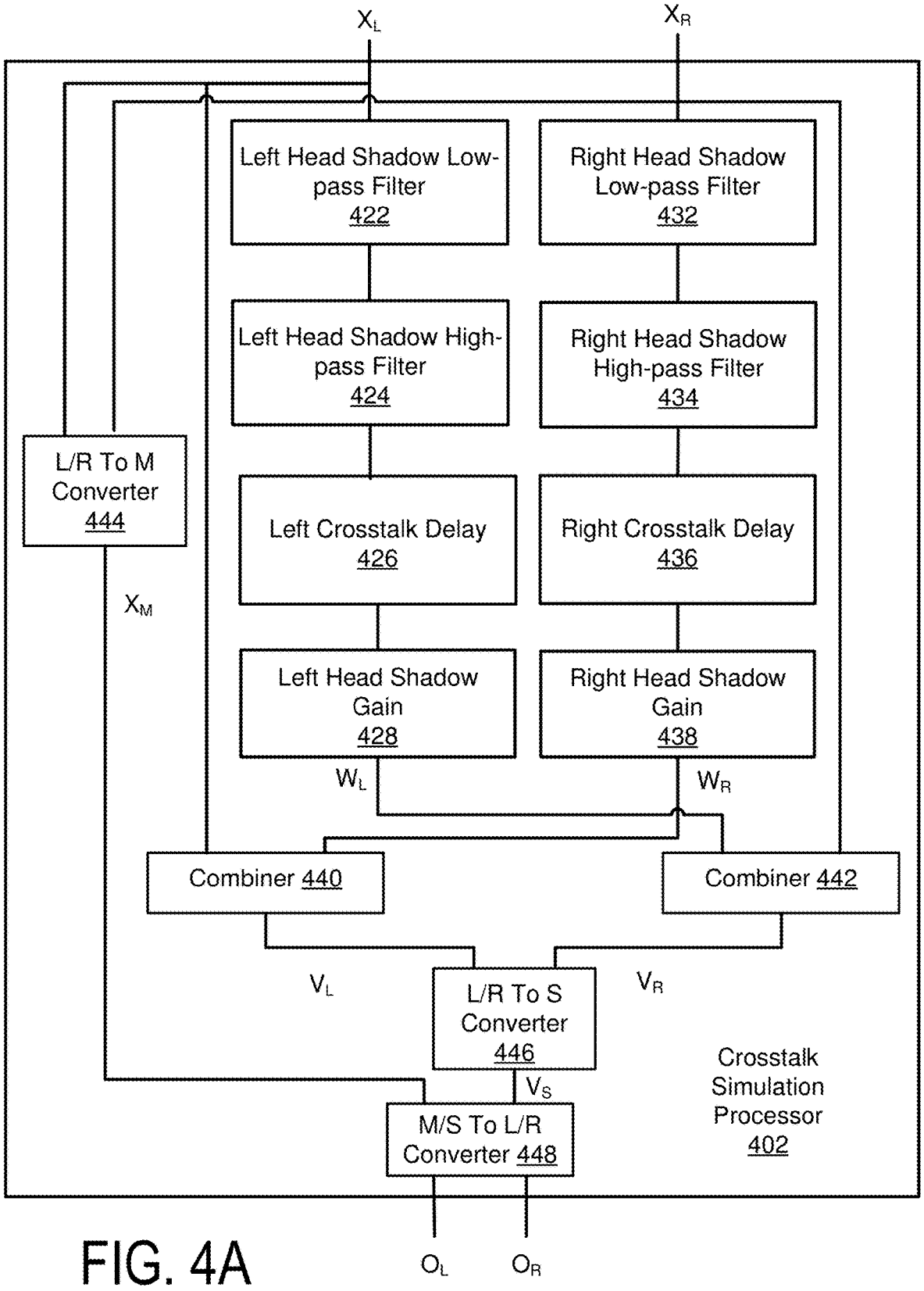
FIGS. 4A, 4B, 4C, 4D, 4E, and 4F each illustrates an example of a crosstalk cancellation processor, according to one embodiment.

FIG. 4A illustrates a crosstalk simulation processor 402, according to one embodiment. The crosstalk simulation processor 402 receives a left channel $X_L$ and a right channel $X_R$, and performs crosstalk simulation on the channels $X_L$, $X_R$ to generate a left output channel $O_L$ and a right output channel $O_R$.

The crosstalk simulation processor 402 includes a left head shadow low-pass filter 422, a left head shadow high-pass filter 424, a left cross-talk delay 426, and a left head shadow gain 428 to process the left input channel $X_L$. The crosstalk simulation processor 402 further includes a right head shadow low-pass filter 432, a right head shadow high-pass filter 434, a right cross-talk delay 436, and a right head shadow gain 438 to process the right input channel $X_R$. The crosstalk simulation processor 402 further includes combiners 440 and 442, an L/R to M converter 444, an L/R to S converter 446, and an M/S to L/R converter 448.

The left head shadow low-pass filter 422 and the left head shadow high-pass filter 424 receive the left input channel $X_L$ and apply modulations that model the frequency response of the signal after passing through the listener's head. The use of both low-pass and high-pass filters may result in a more accurate model of the frequency response though the listener's head. In some embodiments, only one of the low-pass filter 422 or high-pass filter 424 are used. The output of the left head shadow high-pass filter 424 is provided to the left cross-talk delay 426, which applies a time delay to the output of the left head shadow high-pass filter 424. The time delay represents trans-aural distance that is traversed by a contralateral sound component relative to an ipsilateral sound component. The frequency response can be generated based on empirical experiments to determine frequency dependent characteristics of sound wave modulation by the listener's head. For example and with reference to FIG. 1B, the contralateral sound component $\mathbf{112}_L$ that propagates to the right ear $\mathbf{125}_R$ can be derived from the ipsilateral sound component $\mathbf{118}_L$ that propagates to the left ear $\mathbf{125}_L$ by filtering the ipsilateral sound component $\mathbf{118}_L$ with a frequency response that represents sound wave modulation from trans-aural propagation, and a time delay that models the increased distance the contralateral sound component $\mathbf{112}_L$ travels (relative to the ipsilateral sound component $\mathbf{118}_R$) to reach the right ear $\mathbf{125}_R$. The left head shadow gain 428 applies a gain to the output of the left crosstalk delay 426 to generate the left crosstalk simulation channel $W_L$.

Similarly for the right input channel $X_R$, the right head shadow low-pass filter 432 and right head shadow high-pass filter 434 receives the right input channel $X_R$ and applies a modulation that models the frequency response of the listener's head. The output of the right head shadow high-pass filter 434 is provided to the right crosstalk delay 436, which applies a time delay. The right head shadow gain 438 applies a gain to the output of the right crosstalk delay 436 to generate the right crosstalk simulation channel $W_R$.

In some embodiments, the head shadow low-pass filters 422 and 432 have a cutoff frequency of 2,023 Hz. The head shadow high-pass filters 424 and 434 have a cutoff frequency of 150 Hz. The cross-talk delays 426 and 436 apply a 0.792 millisecond delay. The head shadow gains 428 and 438 apply a −14.4 dB gain. The application of the head shadow filters, crosstalk delay, and head shadow gain for each of the left and right channels may be performed in different orders.

In some embodiments, a head shadow filter is integrated with a head shadow gain. For example, the filter head shadow low-pass filters 422 and 432 may apply the gain of the head shadow gain 428 and 438 as part of a filtering function. In that sense, applying a filter to a signal or channel may include wideband adjustment of gain level in addition to adjustments based on frequency.

The combiner 440 is coupled to the right head shadow gain 438 and the L/R to S converter 446. The combiner 440 receives the left input channel $X_L$ and the right crosstalk simulation channel $W_R$, and generates a left crosstalk channel $V_L$ by adding the left input channel $X_L$ and the right crosstalk simulation channel $W_R$. The combiner 442 is coupled to the left head shadow gain 428 and the L/R to S converter 446. The combiner 442 receives the right input channel $X_R$ and the left crosstalk simulation channel $W_L$, and generates a right crosstalk channel $V_R$ by adding the right input channel $X_R$ and the left crosstalk simulation channel $W_L$.

The L/R to S converter 446 receives the left crosstalk channel $V_L$ and the right crosstalk channel $V_R$, and generates a side crosstalk channel $V_S$ based on a difference between the left crosstalk channel $V_L$ and the right crosstalk channel $V_R$.

The L/R to M converter 444 is coupled to the M/S to L/R converter 448. The L/R to M converter 444 receives the left input channel $X_L$ and the right input channel $X_R$, and generates a mid channel $X_M$ based on a sum of the left input channel $X_L$ and the right input channel $X_R$.

The M/S to L/R converter 448 is coupled to the L/R to M converter 444 and the L/R to S converter 446. The M/S to L/R converter 448 receives the side crosstalk channel $V_S$ and the mid channel $X_M$, and generates the left output channel $O_L$ and the right output channel $O_R$. The left output channel $O_L$ may be generated based on a sum of the side crosstalk channel Vs and the mid channel $X_M$, and the right output channel $O_R$ may be generated based on a difference between the side crosstalk channel $V_S$ and the mid channel $X_M$. The left output channel $O_L$ is a left crosstalk simulated channel of a crosstalk processed signal generated by the crosstalk simulation processor 402, and the right output channel $O_R$ is a right crosstalk simulated channel of a crosstalk processed signal generated by the crosstalk simulation processor 402.

Figure 4B:
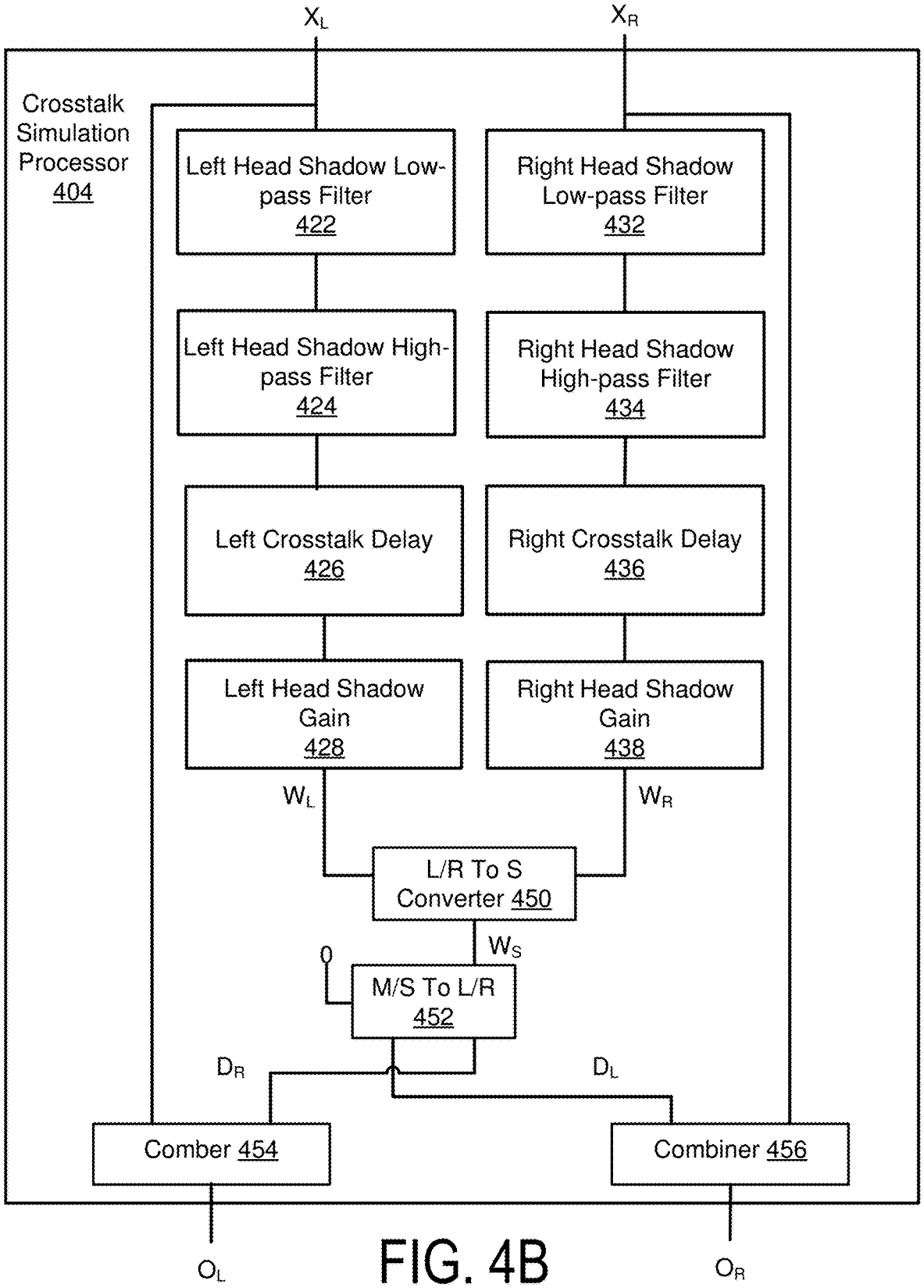

FIG. 4B illustrates a crosstalk simulation processor 404, according to one embodiment. The crosstalk simulation processor 404 is like the crosstalk simulation processor 402, but includes improved processing efficiency. The crosstalk simulation processor 404 includes the left head shadow low-pass filter 422, the left head shadow high-pass filter 424, the left cross-talk delay 426, the left head shadow gain 428, the right head shadow low-pass filter 432, the right head shadow high-pass filter 434, the right cross-talk delay 436, and the right head shadow gain 438. These components in the crosstalk simulation processor 404 operate similarly to corresponding components in the crosstalk simulation processor 402. The crosstalk simulation processor 404 further includes an L/R to S converter 450 coupled to the left head shadow gain 428 and the right head shadow gain 438, an M/S to L/R converter 452 coupled to the L/R to S converter 450, and combiners 454 and 456 each coupled to the M/S to L/R converter 452.

The L/R to S converter 450 receives the left crosstalk simulation channel $W_L$ and the right crosstalk simulation channel $W_R$, and generates a side crosstalk simulation channel $W_S$ based on a difference between the left crosstalk simulation channel $W_L$ and the right crosstalk simulation channel $W_R$.

The M/S to L/R converter 452 receives the side crosstalk simulation channel $W_S$ and a zero mid channel, and generates a left crosstalk channel $D_L$ and a right crosstalk channel $D_R$. The left crosstalk channel $D_L$ may be generated based on a sum of the side crosstalk simulation channel $W_S$ and the zero mid channel, and the right crosstalk channel $D_R$ may be generated based on a difference between the zero mid channel and the side crosstalk simulation channel $W_S$.

The combiner 454 receives the right crosstalk channel $D_R$ and the left input channel $X_L$, and generates the left output channel $O_L$ by adding the right crosstalk channel $D_R$ and the left input channel $X_L$. The combiner 456 receives the left crosstalk channel $D_L$ and the right input channel $X_R$, and generates the right output channel $O_R$ by adding the left crosstalk channel $D_L$ and the right input channel $X_R$. The left output channel $O_L$ is a left crosstalk simulated channel of a crosstalk processed signal generated by the crosstalk simulation processor 404, and the right output channel $O_R$ is a right crosstalk simulated channel of a crosstalk processed signal generated by the crosstalk simulation processor 404.

Figure 4C:
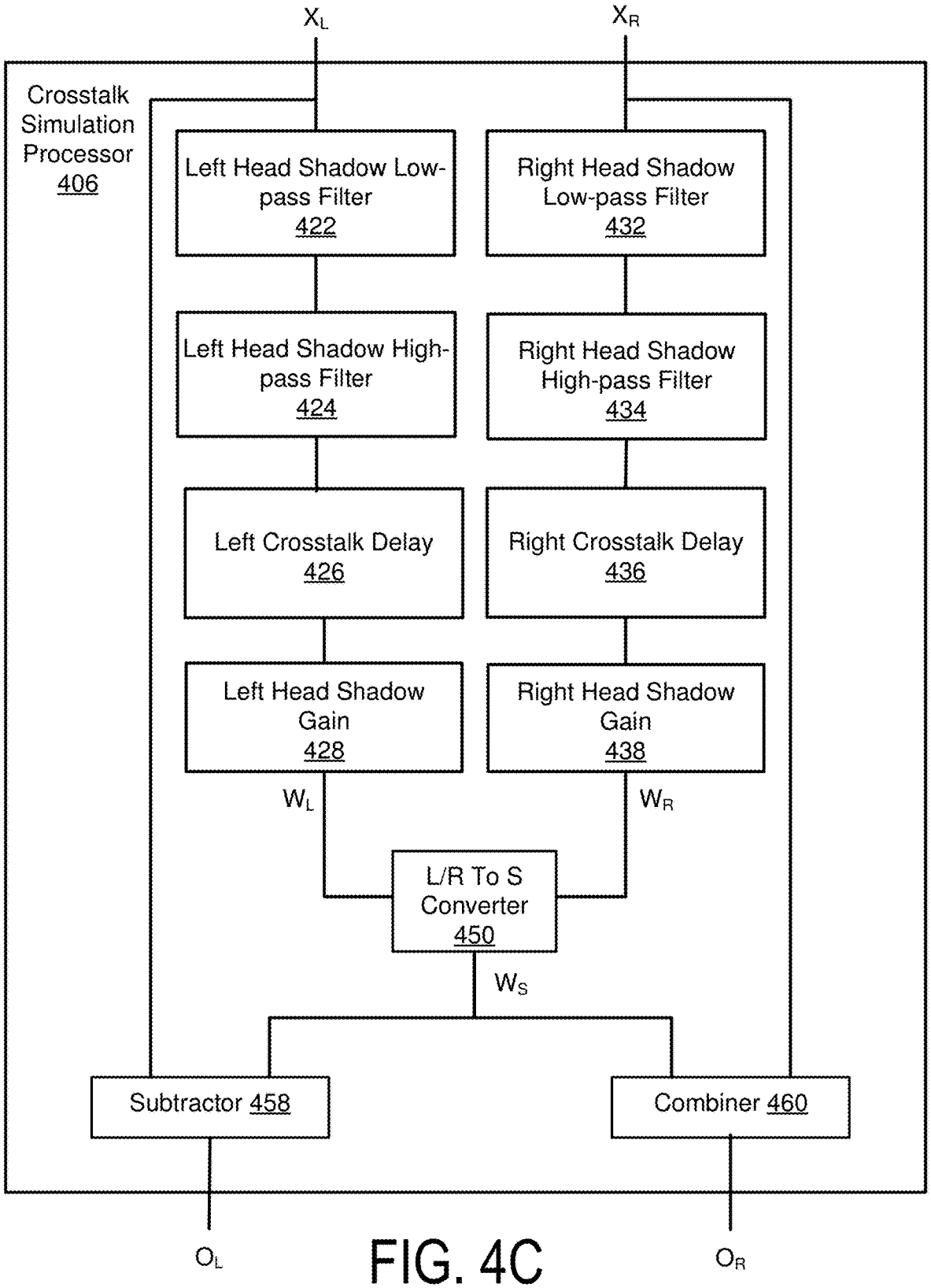

FIG. 4C illustrates a crosstalk simulation processor 406, according to one embodiment. The crosstalk simulation processor 406 is like the crosstalk simulation processor 404, but includes improved processing efficiency. The crosstalk simulation processor 406 includes the left head shadow low-pass filter 422, the left head shadow high-pass filter 424, the left cross-talk delay 426, the left head shadow gain 428, the right head shadow low-pass filter 432, the right head shadow high-pass filter 434, the right cross-talk delay 436, the right head shadow gain 438, and the L/R to S converter 450. These components in the crosstalk simulation processor 406 operate similarly to corresponding components in the crosstalk simulation processor 404.

The crosstalk simulation processor 406 further includes a subtractor 458 and a combiner 460, each coupled to the L/R to S converter 450. The subtractor 458 receives the left input channel $X_L$ and the side crosstalk simulation channel $W_S$, and generates the left output channel $O_L$ based on a difference between the left input channel $X_L$ and the side crosstalk simulation channel $W_S$. The combiner 460 receives the right input channel $X_R$ and the side crosstalk simulation channel $W_S$, and generates the right output channel $O_R$ based on a sum of the right input channel $X_R$ and the side crosstalk simulation channel $W_S$. The left output channel $O_L$ is a left crosstalk simulated channel of a crosstalk processed signal generated by the crosstalk simulation processor 406, and the right output channel $O_R$ is a right crosstalk simulated channel of a crosstalk processed signal generated by the crosstalk simulation processor 406.

A common goal of crosstalk simulation is that of perceptually simulating the experience of listening to a symmetric loudspeaker system over headphones, where the overall crosschannel signals are transformed identically. That is, the left channel may be delayed, filtered, and scaled identically to the right channel before summing to the opposite channel. If we assume symmetry in the left/right crosschannel signal transformations, FIGS. 4D through 4F can illustrate examples of crosstalk simulation processors with improved processing efficiency relative to the crosstalk simulation processors shown in FIGS. 4A through 4C. In particular, crosstalk processing is applied to the side channel $X_S$ generated from the left input channel $X_L$ and right input channel $X_R$, while the mid channel $X_M$ is not generated or otherwise bypasses the crosstalk processing that is applied to the side channel $X_S$.

Figure 4D:
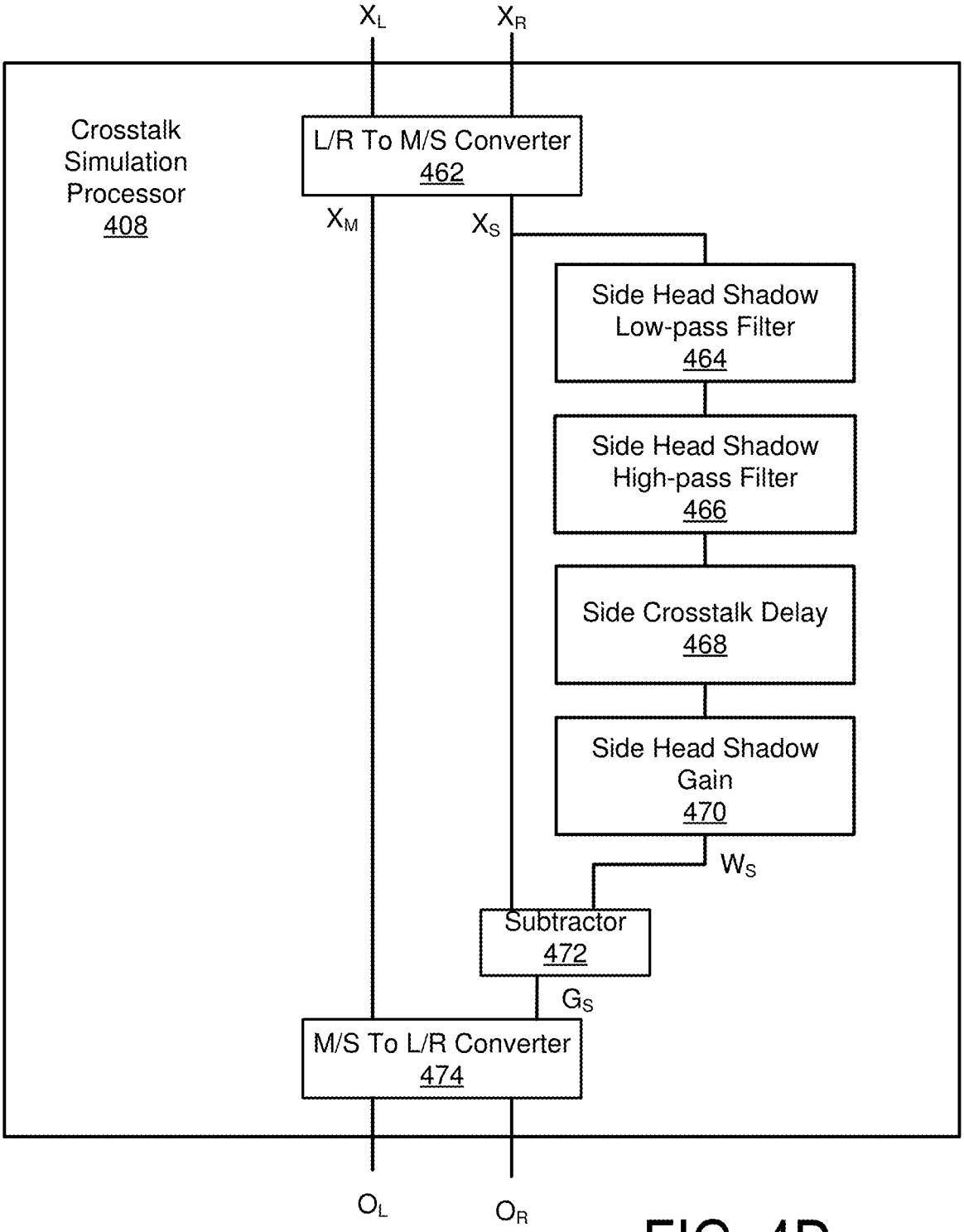

FIG. 4D illustrates a crosstalk simulation processor 408, according to one embodiment. The crosstalk simulation processor 408 includes an L/R to M/S converter 462, a side head shadow low-pass filter 464, a side head shadow high-pass filter 466, a side crosstalk delay 468, a side head shadow gain 470, a subtractor 472, and an M/S to L/R converter 474.

The L/R to M/S converter 462 receives the left input channel $X_L$ and the right input channel $X_R$, and generates a mid channel $X_M$ and a side channel $X_S$. The side channel $X_S$ may be generated based on a difference between the left input channel $X_L$ and the right input channel $X_R$. The mid channel $X_M$ may be generated based on a sum of the left input channel $X_L$ and the right input channel $X_R$.

The side head shadow low-pass filter 464 and the side head shadow high-pass filter 466 receive the side channel $X_S$ and apply modulations that model the frequency response of the signal after passing through the listener's head. The use of both low-pass and high-pass filters may result in a more accurate model of the frequency response though the listener's head. In some embodiments, only one of the low-pass filter 464 or high-pass filter 466 are used. The output of the side head shadow high-pass filter 466 is provided to the side cross-talk delay 468, which applies a time delay to the output of the side head shadow high-pass filter 466. The side head shadow gain 470 applies a gain to the output of the side crosstalk delay 426 to generate a side crosstalk simulation channel $W_S$. The application of the head shadow filters, crosstalk delay, and head shadow gain for the side channel $X_S$ may be performed in different orders.

The subtractor 472 is coupled to the L/R to M/S converter 462 and side head shadow gain 470. The subtractor 472 receives the side channel $X_S$ and the side crosstalk simulation channel $W_S$, and generates a side crosstalk channel $G_s$ based on a difference between the side channel $X_S$ and the side crosstalk simulation channel $W_S$.

The M/S to L/R converter 474 is coupled to the L/R to M/S converter 462 and the subtractor 472. The M/S to L/R converter 474 receives the mid channel $X_M$ and the side crosstalk channel $G_s$, and generates the left output channel $O_L$ and the right output channel $O_R$. The left output channel $O_L$ may be generated based on a sum of the mid channel $X_M$ and the side crosstalk channel $G_s$, and the right output channel $O_L$ may be generated based on a difference between the mid channel $X_M$ and the side crosstalk channel $G_s$. The left output channel $O_L$ is a left crosstalk simulated channel of a crosstalk processed signal generated by the crosstalk simulation processor 408, and the right output channel $O_R$ is a right crosstalk simulated channel of a crosstalk processed signal generated by the crosstalk simulation processor 408.

Figure 4E:
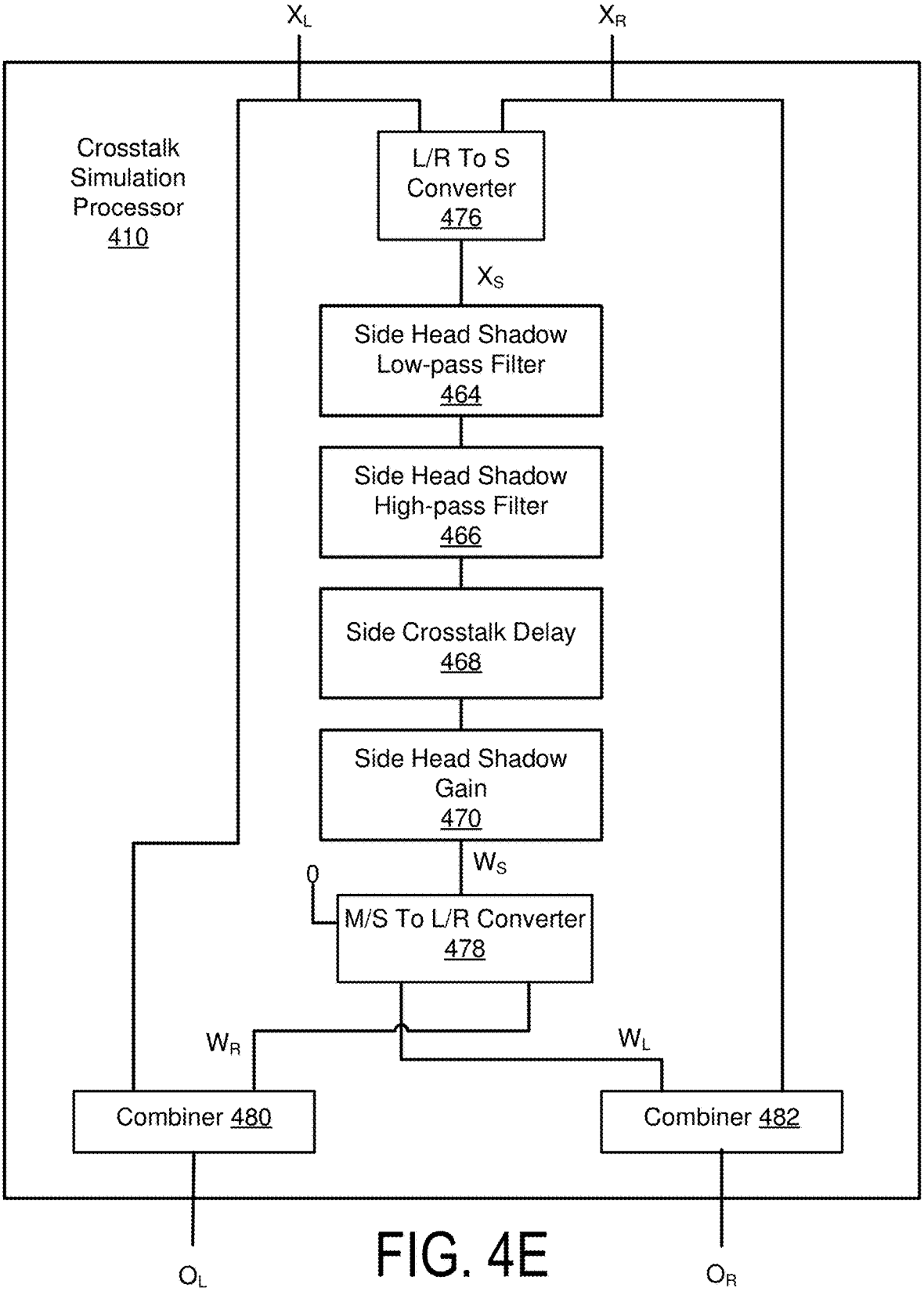

FIG. 4E illustrates a crosstalk simulation processor 410, according to one embodiment. The crosstalk simulation processor 410 is like the crosstalk cancellation simulation 408, with similar processing efficiency. The crosstalk simulation processor 410 includes the side head shadow low-pass filter 464, the side head shadow high-pass filter 466, the side crosstalk delay 468, and the side head shadow gain 470. These components in the crosstalk simulation processor 410 operate similarly to corresponding components in the crosstalk simulation processor 408.

The crosstalk simulation processor 410 further includes an L/R to S converter 476 coupled to the side head shado low-pass filter 464, an M/S to L/R converter 478 coupled to the side head shadow gain 470, a combiner 480 coupled to the M/S to L/R converter 478, and a combiner 482 coupled to the M/S to L/R converter 478. The L/R to S converter 476 receives the left input channel $X_L$ and the right input channel $X_R$, and generates the side channel $X_S$ based on a difference between the left input channel $X_L$ and the right input channel $X_R$. The side channel $X_S$ is processed by the side head shadow low-pass filter 464, the side head shadow high-pass filter 466, the side crosstalk delay 468, and the side head shadow gain 470 to generate the side crosstalk simulation channel $W_S$.

The M/S to L/R converter 478 receives the side crosstalk simulation channel $W_S$ and a zero mid channel, and generates a left crosstalk simulation channel $W_L$ and a right crosstalk simulation channel $W_R$. The left crosstalk simulation channel $W_L$ may be generated based on a sum of the side crosstalk simulation channel $W_S$ and the zero mid channel, and the right crosstalk simulation channel $W_R$ may be generated based on a difference between the zero mid channel and the side crosstalk simulation channel $W_S$.

The combiner 480 receives the left input channel $X_L$ and the right channel $W_R$, and generates the left output channel $O_L$ by adding the left input channel $X_L$ and the right crosstalk simulation channel $W_R$. The combiner 482 receives the right input channel $X_R$ and the left channel crosstalk simulation $W_L$, and generates the right output channel $O_R$ by adding the right input channel $X_R$ and the left crosstalk simulation channel $W_L$. The left output channel $O_L$ is a left crosstalk simulated channel of a crosstalk processed signal generated by the crosstalk simulation processor 410, and the right output channel $O_R$ is a right crosstalk simulated channel of a crosstalk processed signal generated by the crosstalk simulation processor 410.

Figure 4F:
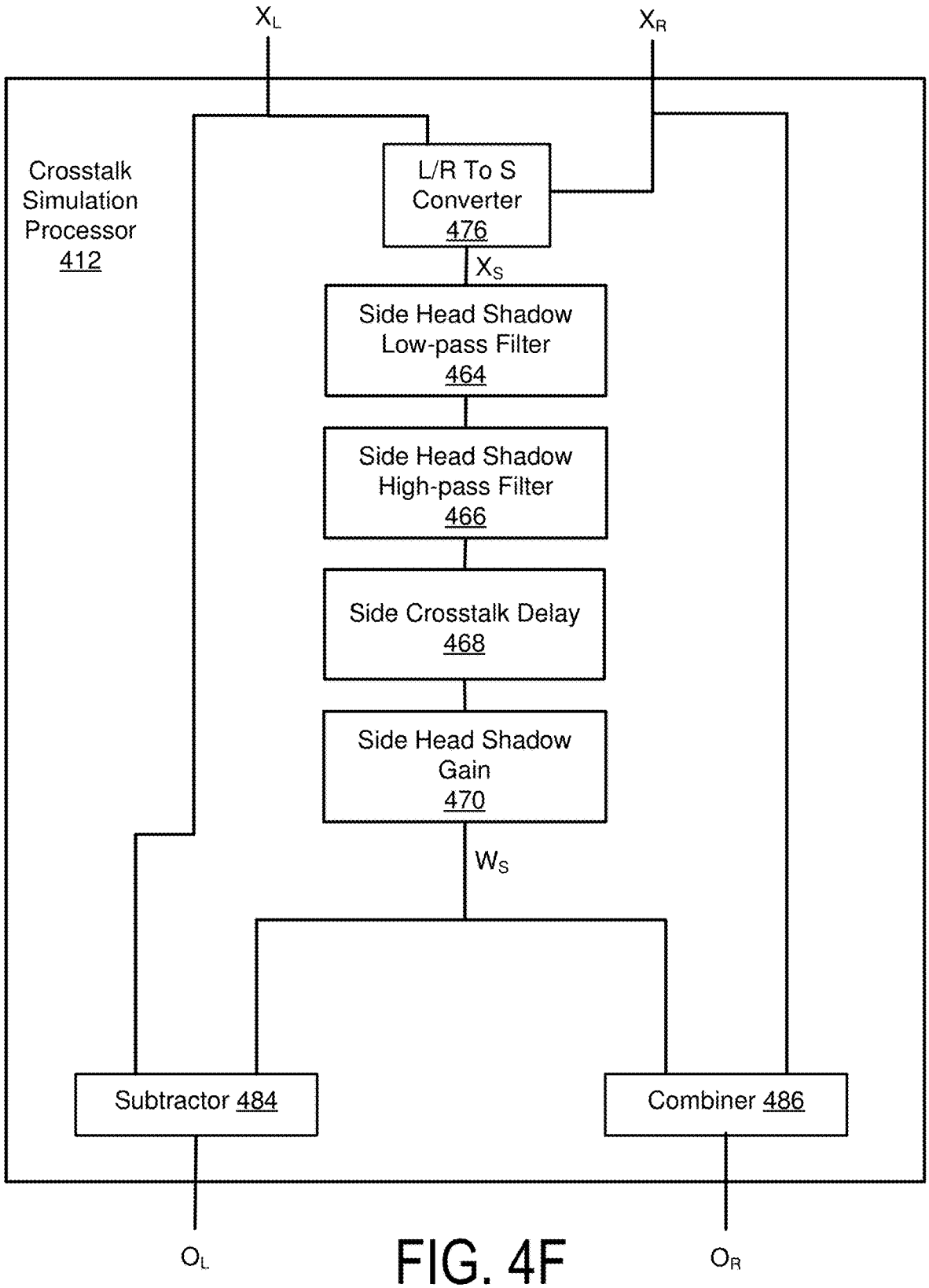

FIG. 4F illustrates a crosstalk simulation processor 412, according to one embodiment. The crosstalk simulation processor 412 is like the crosstalk simulation processor 410, but includes improved processing efficiency. The crosstalk simulation processor 412 includes the L/R to S converter 476, the side head shadow low-pass filter 464, the side head shadow high-pass filter 466, the side crosstalk delay 468, and the side head shadow gain 470. These components in the crosstalk simulation processor 412 operate similarly to corresponding components in the crosstalk simulation processor 410.

The crosstalk simulation processor 412 further includes a subtractor 484 and a combiner 486, each coupled to the side head shadow gain 470. The subtractor 484 receives the left input channel $X_L$ and the side crosstalk simulation channel $W_S$, and generates the left output channel $O_L$ based on a difference between the left input channel $X_L$ and the side crosstalk simulation channel $W_S$. The combiner 486 receives the right input channel $X_R$ and the side crosstalk simulation channel $W_S$, and generates the right output channel $O_R$ based on a sum of the right input channel $X_R$ and the side crosstalk simulation channel $W_S$. The left output channel $O_L$ is a left crosstalk simulated channel of a crosstalk processed signal generated by the crosstalk simulation processor 412, and the right output channel $O_R$ is a right crosstalk simulated channel of a crosstalk processed signal generated by the crosstalk simulation processor 412.

The crosstalk simulation processors shown in FIGS. 4A through 4F can produce equivalent output channels $O_L$, $O_R$ from the input channels $X_L$, $X_R$. Let A be a linear operation (e.g., filter) that encapsulates the functionality of a head shadow low-pass filter, head shadow high-pass filter, crosstalk delay, and head shadow gain. The output channels $O_L$ and $O_R$ for the crosstalk simulation processor 402 shown in FIG. 4A may be defined by Equations 4 and 5, respectively.

The output channels $O_L$ and $O_R$ for the crosstalk simulation processor 404 shown in FIG. 4B may be defined by Equations 6 and 7, respectively. The output channels $O_L$ and $O_R$ for the crosstalk simulation processor 406 shown in FIG. 4C may be defined by Equations 8 and 9, respectively. The output channels $O_L$ and $O_R$ for the crosstalk simulation processor 408 shown in FIG. 4D may be defined by Equations 10 and 11, respectively. The output channels $O_L$ and $O_R$ for the crosstalk simulation processor 410 shown in FIG. 4E may be defined by Equations 12 and 13, respectively. The output channels $O_L$ and $O_R$ for the crosstalk simulation processor 412 shown in FIG. 4F may be defined by Equations 14 and 15, respectively. The Equations 4, 6, 8, 10, 12, and 14 for the left output channel $O_L$ are equivalent, and the Equations 5, 7, 9, 11, 13, and 14 for the right output channel $O_R$ are equivalent.

Example Crosstalk Compensation Processor

Figure 5:
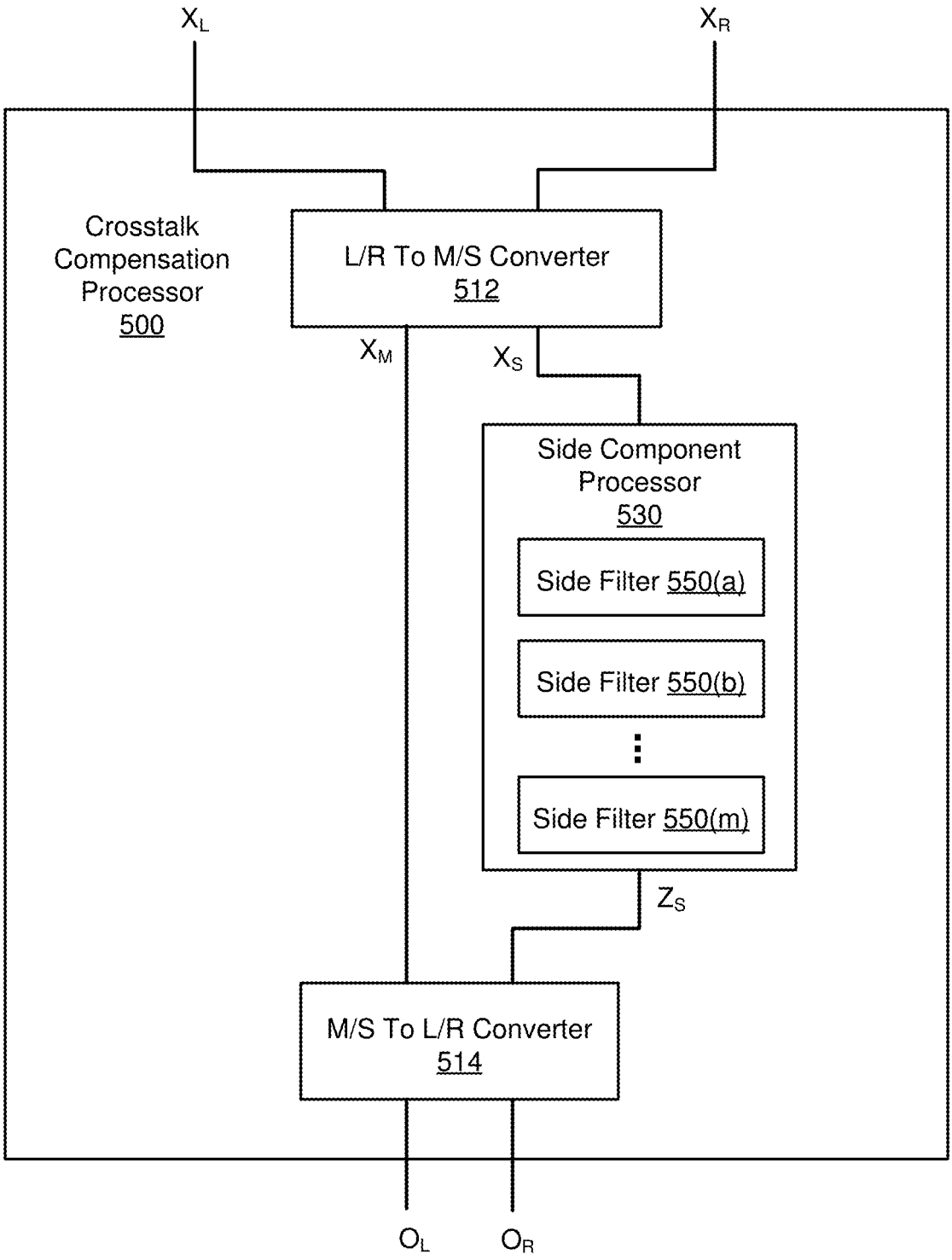
FIG. 5 illustrates an example of a crosstalk compensation processor, according to one embodiment.

FIG. 5 illustrates an example of a crosstalk compensation processor 500, according to one embodiment. The crosstalk compensation processor 500 is an example of a crosstalk compensation processor 204 of an audio processing system shown in FIGS. 2A through 2C. The crosstalk compensation processor 500 receives left and right input channels, and generates left and right output channels by applying a crosstalk compensation on the input channels. In particular, the crosstalk compensation processor 500 applies the crosstalk compensation on the side channel of an audio signal to compensate for spectral artifacts caused by crosstalk processing on the side channel, while the mid channel of the audio signal bypasses the crosstalk compensation applied to the side channel.

The crosstalk compensation processor 500 includes an L/R to M/S converter 512, a side component processor 530, and an M/S to L/R converter 514. The L/R to M/S converter 512 receives the left input channel $X_L$ and the right input channel $X_R$, generates the mid channel $X_m$ based on a sum of the input channels $X_L$, $X_R$, and generates the side channel $X_s$ based on a difference between the input channels $X_L$, $X_R$.

The side component processor 530 includes a plurality of filters 550, such as m side filters 550(*a*), 550(*b*) through 550(*m*). The side component processor 530 generates a side crosstalk compensation channel $Z_s$ by processing the spatial channel $X_s$. In some embodiments, a frequency response plot of the spatial $X_s$ with crosstalk processing can be obtained through simulation. By analyzing the frequency response plot, any spectral defects such as peaks or troughs in the frequency response plot over a predetermined threshold (e.g., 10 dB) occurring as an artifact of the crosstalk processing can be estimated. The side crosstalk compensation channel $Z_s$ can be generated by the side component processor 530 to compensate for the estimated peaks or troughs. Specifically, based on the specific delay, filtering frequency, and gain applied in the crosstalk processing, peaks and troughs shift up and down in the frequency response, causing variable amplification and/or attenuation of energy in specific regions of the spectrum. Each of the side filters 550 may be configured to adjust for one or more of the peaks and troughs. In some embodiments, the side component processor 530 may include a different number of filters.

In some embodiments, the side filters 550 may include a biquad filter having a transfer function defined by Equation 16:

$$H(z) = \frac{b_0 + b_1 z^{-1} + b_2 z^{-2}}{a_0 + a_1 z^{1} + a_2 z^{-2}} \quad \text{Eq. (16)}$$

where z is a complex variable, and $a_0$, $a_1$, $a_2$, $b_0$, $b_1$, and $b_2$ are digital filter coefficients. One way to implement such a filter is the direct form I topology as defined by Equation 17:

$$Y[n] = \frac{b_0}{a_0}X[n-1] + \frac{b_1}{a_0}X[n-1] + \frac{b_2}{a_0}X[n-2] - \frac{a_1}{a_0}Y[n-1] - \frac{a_2}{a_0}Y[n-2] \quad \text{Eq. (17)}$$

where X is the input vector, and Y is the output. Other topologies may be used, depending on their maximum word-length and saturation behaviors.

The biquad can then be used to implement a second-order filter with real-valued inputs and outputs. To design a discrete-time filter, a continuous-time filter is designed, and then transformed into discrete time via a bilinear transform. Furthermore, resulting shifts in center frequency and bandwidth may be compensated using frequency warping.

For example, a peaking filter may have an S-plane transfer function defined by Equation 18:

$$H(s) = \frac{s^2 + s(A/Q) + 1}{s^2 + s(A/Q) + 1} \quad \text{Eq. (18)}$$

where s is a complex variable, A is the amplitude of the peak, and Q is the filter "quality," and the digital filter coefficients are defined by:

$$b_0 = 1 + \alpha A$$
$$b_1 = -2 * \cos(\omega_0)$$
$$b_2 = 1 - \alpha A$$
$$a_0 = 1 + \frac{\alpha}{A}$$
$$a_1 = -2\cos(\omega_0)$$
$$a_2 = 1 + \frac{\alpha}{A}$$

where $\omega_0$ is the center frequency of the filter in radians and $$\alpha = \frac{\sin(\omega_0)}{2Q}.$$

Furthermore, the filter quality Q may be defined by Equation 19:

$$Q = \frac{f_c}{\Delta f} \quad \text{Eq. (19)}$$

where $\Delta f$ is a bandwidth and $f_c$ is a center frequency.

The M/S to L/R converter 514 receives the mid channel $X_m$ and the side crosstalk compensation channel $Z_s$, and generates the left output channel $O_L$ and the right output channel $O_R$. The left output channel $O_L$ may be generated based on a sum of the mid channel $X_m$ and the side crosstalk compensation channel $Z_s$. The right output channel $O_R$ may be generated based on a difference between the mid channel $X_m$ and the side crosstalk compensation channel $Z_s$. The left output channel $O_L$ is a left crosstalk compensated channel of a crosstalk compensated signal generated by the crosstalk compensation processor 500, and the right output channel $O_R$ is a right crosstalk compensated channel of a crosstalk compensated signal generated by the crosstalk simulation compensation processor 500.

Example Crosstalk Compensation

FIGS. 6-12B illustrate frequency plots of the comb-filtering artifacts that occur in the side (or spatial) and mid (or non-spatial) signal components as a result of various crosstalk delays and gains. Spectral artifacts in the mid component may be removed by entirely removing the mid component from the crosstalk processing (here, crosstalk cancellation), while applying the crosstalk processing to the side component. In some embodiments, crosstalk compensation is applied using correction filters to the side component to selectively remove spectral artifacts that result from the crosstalk processing applied to the side component. The resulting signal exhibits a spectrally transparent mid channel while retaining the majority of intended spatial crosstalk characteristics (either simulation or cancellation).

FIGS. 6-12B illustrate the effects on the side and mid channels when removing a mid component from crosstalk compensation processing, while selectively applying the crosstalk compensation processing including correction filters to a crosstalk cancelled side channel, for different speaker angle and speaker size configurations. As such, an unchanged mid channel is achieved while selectively flattening the frequency response of the side channel, providing a minimally colored and minimally gain-adjusted post-crosstalk processing output. Compensation filters are implemented on the side channel independently, avoiding all comb-filter peaks/troughs in the mid channel that would otherwise occur, and correcting for all but the lowest comb-filter peaks/troughs in the side channel. The parameters for crosstalk compensation of the side channel can be procedurally derived, tuned by ear and hand, or a combination.

Figure 6:
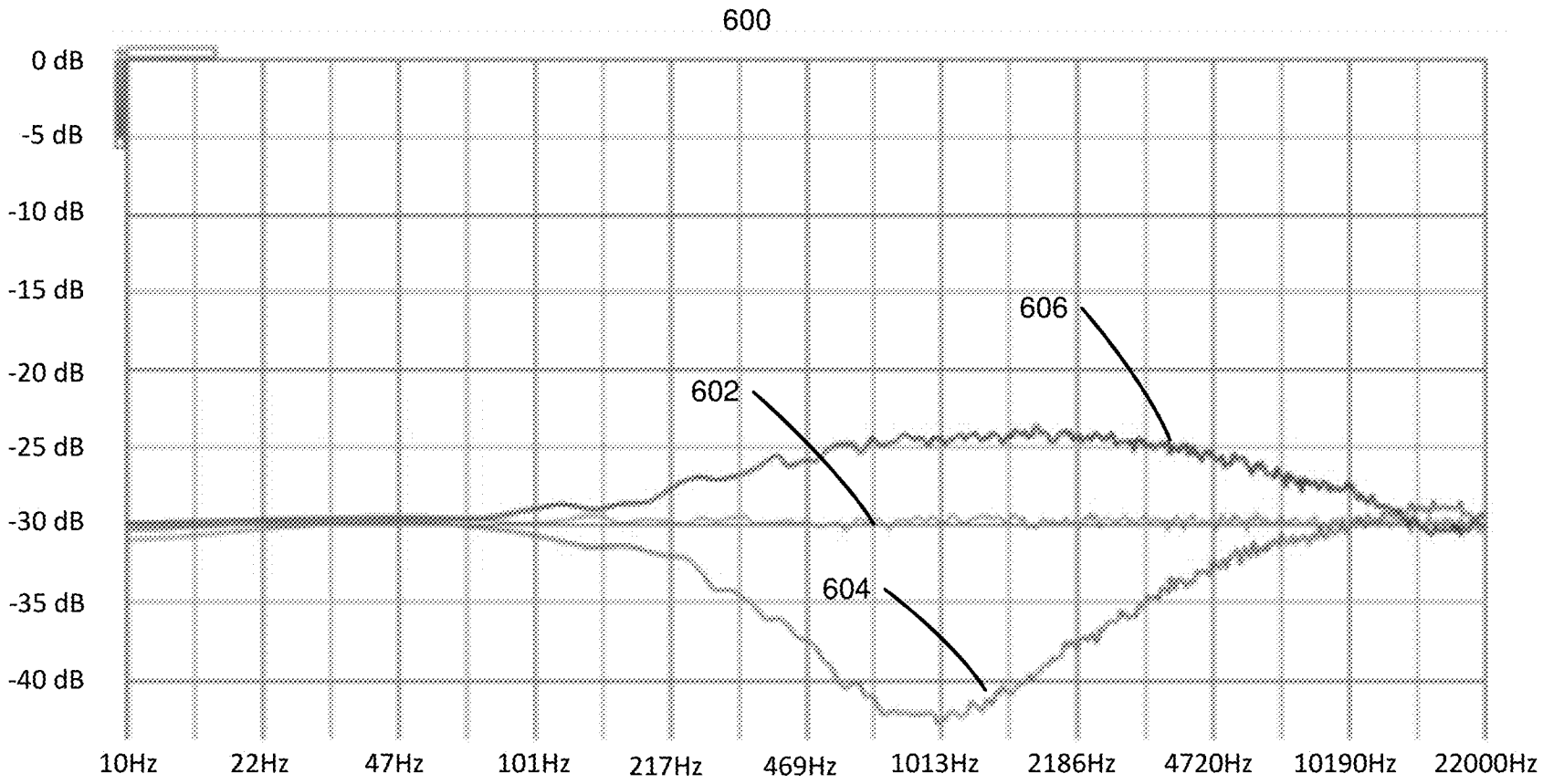
FIG. 6 illustrates a frequency plot of a crosstalk cancellation applied to mid and side channels, according to one embodiment.

FIG. 6 illustrates a frequency plot 600 of a crosstalk cancellation applied to mid and side channels, according to one embodiment. The line 602 is a white noise input signal. The line 604 is a mid channel of the input signal after crosstalk cancellation. The line 606 is a side channel of the input signal after crosstalk cancellation. For a speaker angle of 10 degrees and a small speaker setting, the crosstalk cancellation may include a crosstalk delay of 1 sample @48 KHz sampling rate, a crosstalk gain of −3 dB, and an in-band frequency range defined by a low frequency bypass of 350 Hz and a high frequency bypass of 12000 Hz.

Figure 7:
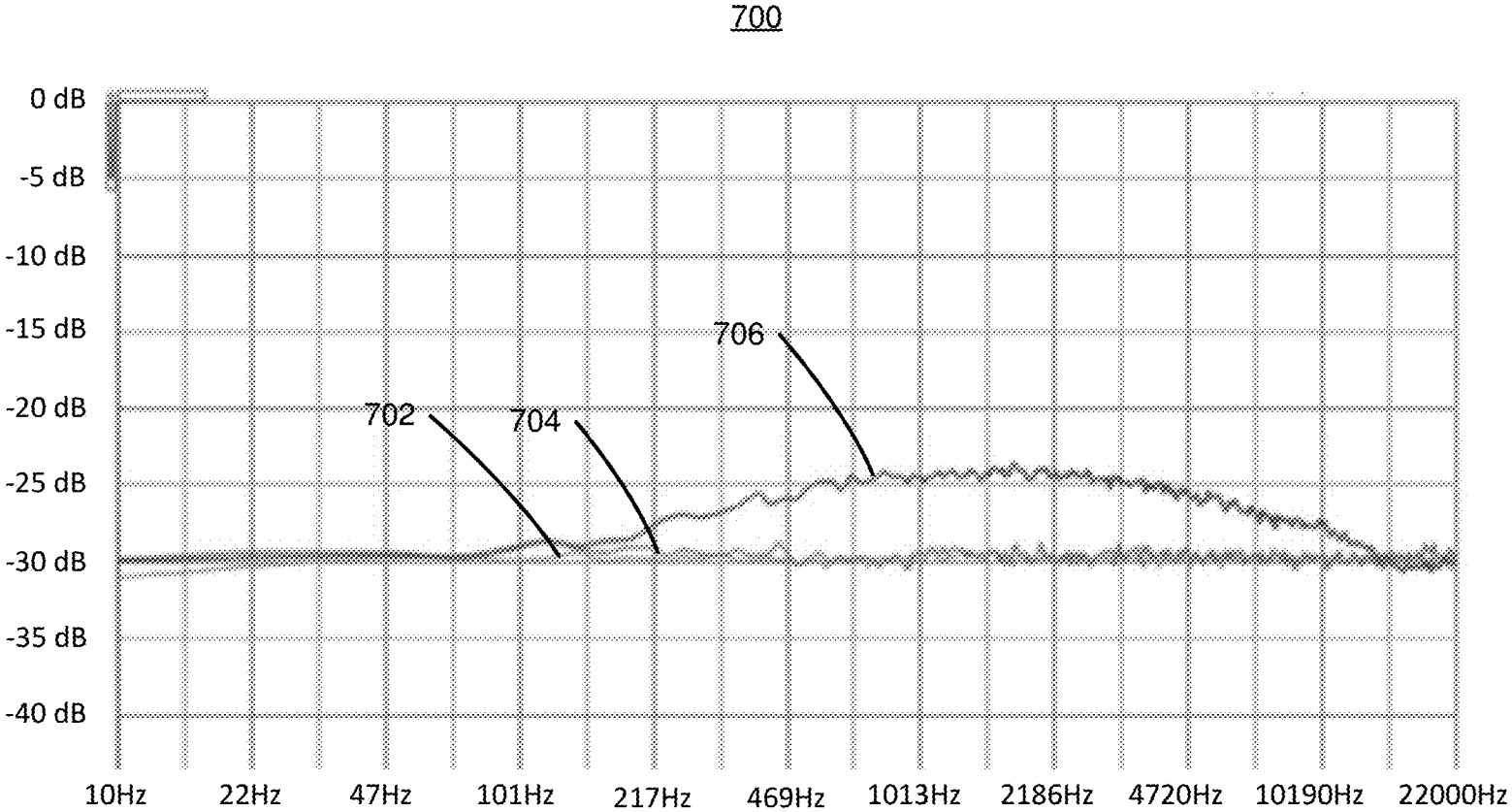
FIG. 7 illustrates a frequency plot for crosstalk cancellation applied to a side channel, according to one embodiment.

FIG. 7 illustrates a frequency plot 700 for crosstalk cancellation applied to a side channel, according to one embodiment. The crosstalk cancellation shown in the plot 700 uses similar parameters as the crosstalk cancellation shown in the plot 600, except applied only to the side channel. In particular, for the speaker angle of 10 degrees and the small speaker setting, the crosstalk cancellation may include the crosstalk delay of 1 sample @48 KHz sampling rate, the crosstalk gain of −3 dB, and the in-band frequency range defined by a low frequency bypass of 350 Hz and a high frequency bypass of 12000 Hz. The line 702 is a white noise input signal. The line 706 is a side channel of the input signal after crosstalk cancellation. The line 704 is a mid channel of the input signal that bypasses the crosstalk cancellation. No crosstalk compensation is applied to the mid and side channels in the frequency plot 700.

Figure 8:
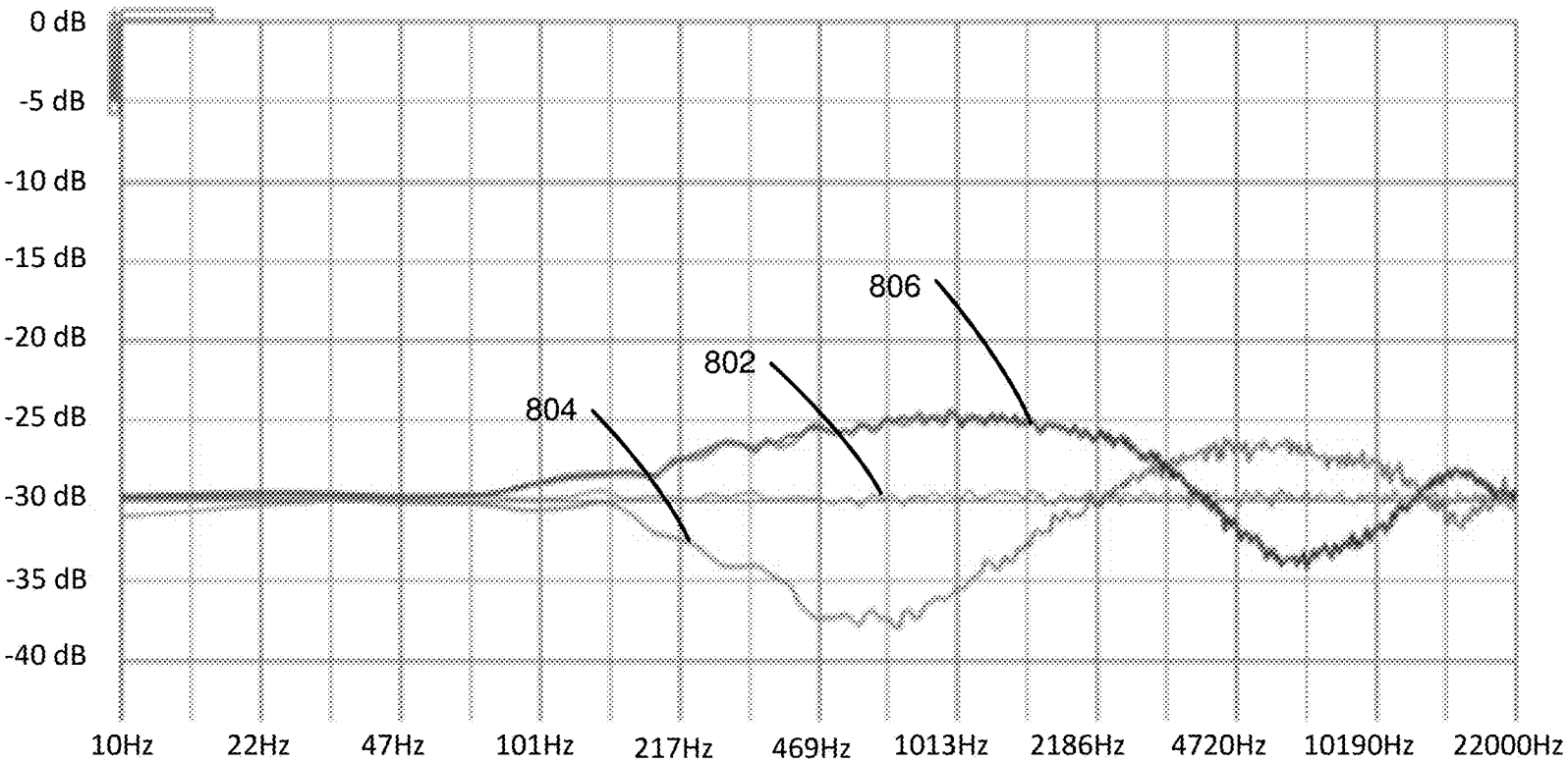
FIG. 8 illustrates a frequency plot of a crosstalk cancellation applied to mid and side channels, according to one embodiment.

FIG. 8 illustrates a frequency plot 800 of a crosstalk cancellation applied to mid and side channels, according to one embodiment. The crosstalk cancellation shown in the plot 800 differs from the crosstalk cancellation shown in the plot 600 in that a different speaker angle and crosschannel delays are used. In particular, for a speaker angle of 30 degrees and a small speaker setting, the crosstalk cancellation may include a crosstalk delay of 3 samples @48 KHz sampling rate, a crosstalk gain of −6.875 dB, and an in-band frequency range defined by a low frequency bypass of 350 Hz and a high frequency bypass of 12000 Hz. The line 802 is a white noise input signal. The line 804 is a mid channel of the input signal with crosstalk cancellation. The line 806 is a side channel of the input signal with crosstalk cancellation.

Figure 9:
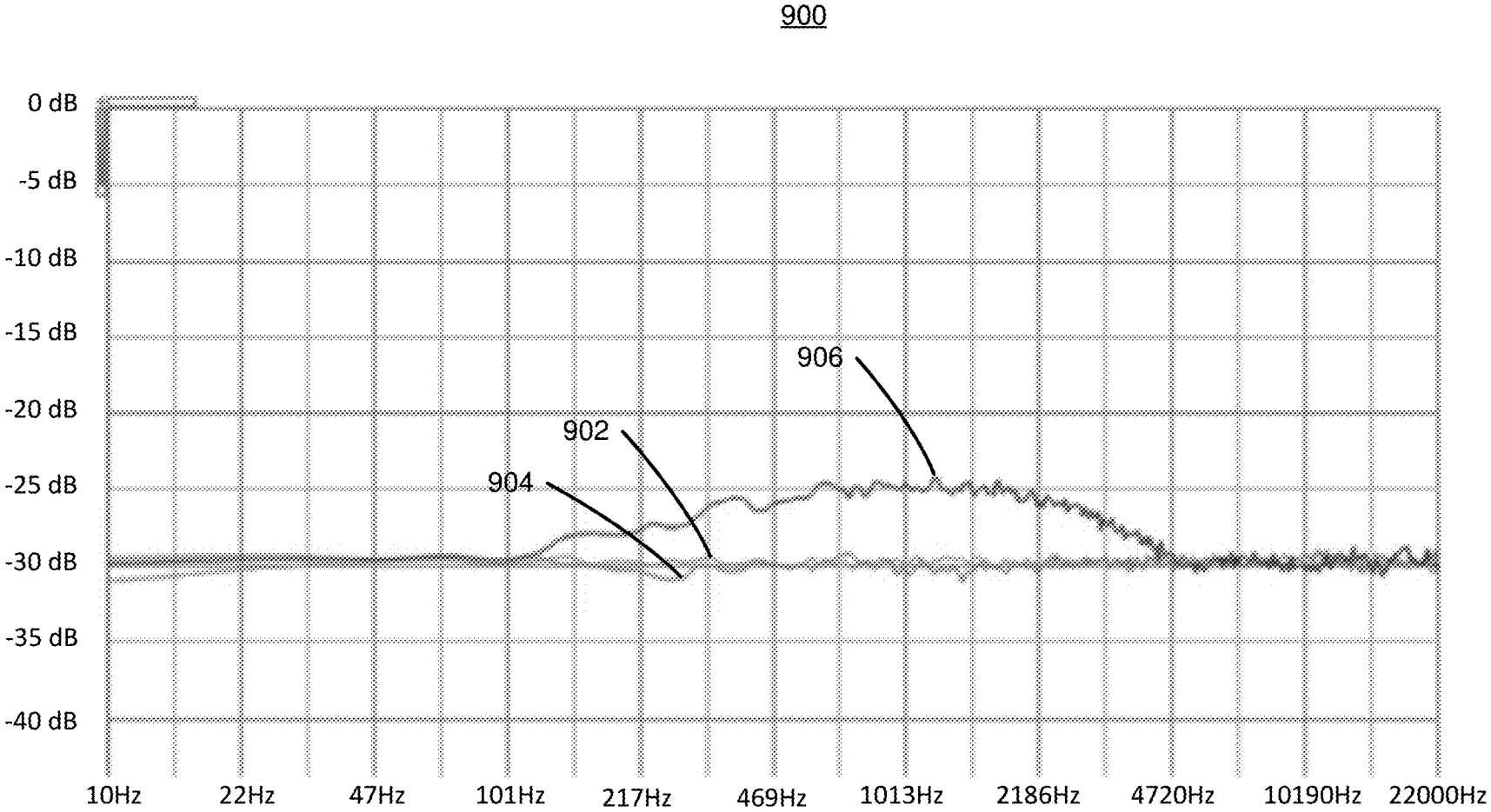
FIG. 9 illustrates a frequency plot for crosstalk cancellation and crosstalk compensation applied to a side channel, according to one embodiment.

FIG. 9 illustrates a frequency plot 900 for crosstalk cancellation and crosstalk compensation applied to a side channel, according to one embodiment. The crosstalk cancellation shown in the plot 900 uses similar parameters as the crosstalk cancellation shown in the plot 800, but is applied only to the side channel. In particular, for the speaker angle of 30 degrees and the small speaker setting, the crosstalk cancellation may include the crosstalk delay of 3 samples @48 KHz sampling rate, the crosstalk gain of −6.875 dB, and the in-band frequency range defined by a low frequency bypass of 350 Hz and a high frequency bypass of 12000 Hz.

The line 902 is a white noise input signal. The line 904 is a mid channel of the input signal that bypasses the crosstalk cancellation and crosstalk compensation. The line 906 is a side channel of the input signal after the crosstalk cancellation and crosstalk compensation. The crosstalk compensation results in the line 906 being generated from the crosstalk canceled side channel shown by the line 806 in the plot 800. For the crosstalk compensation, two side filters are applied to the side channel including a first peaknotch filter having a 6830 Hz center frequency, an 4.0 dB gain, and 1.0 Q, and a second peaknotch filter having a 15500 Hz center frequency, a −2.5 dB gain, and 2.0 Q. In general, the number of side filters applied by the crosstalk compensation processor, as well as their parameters, may vary.

Figure 10:
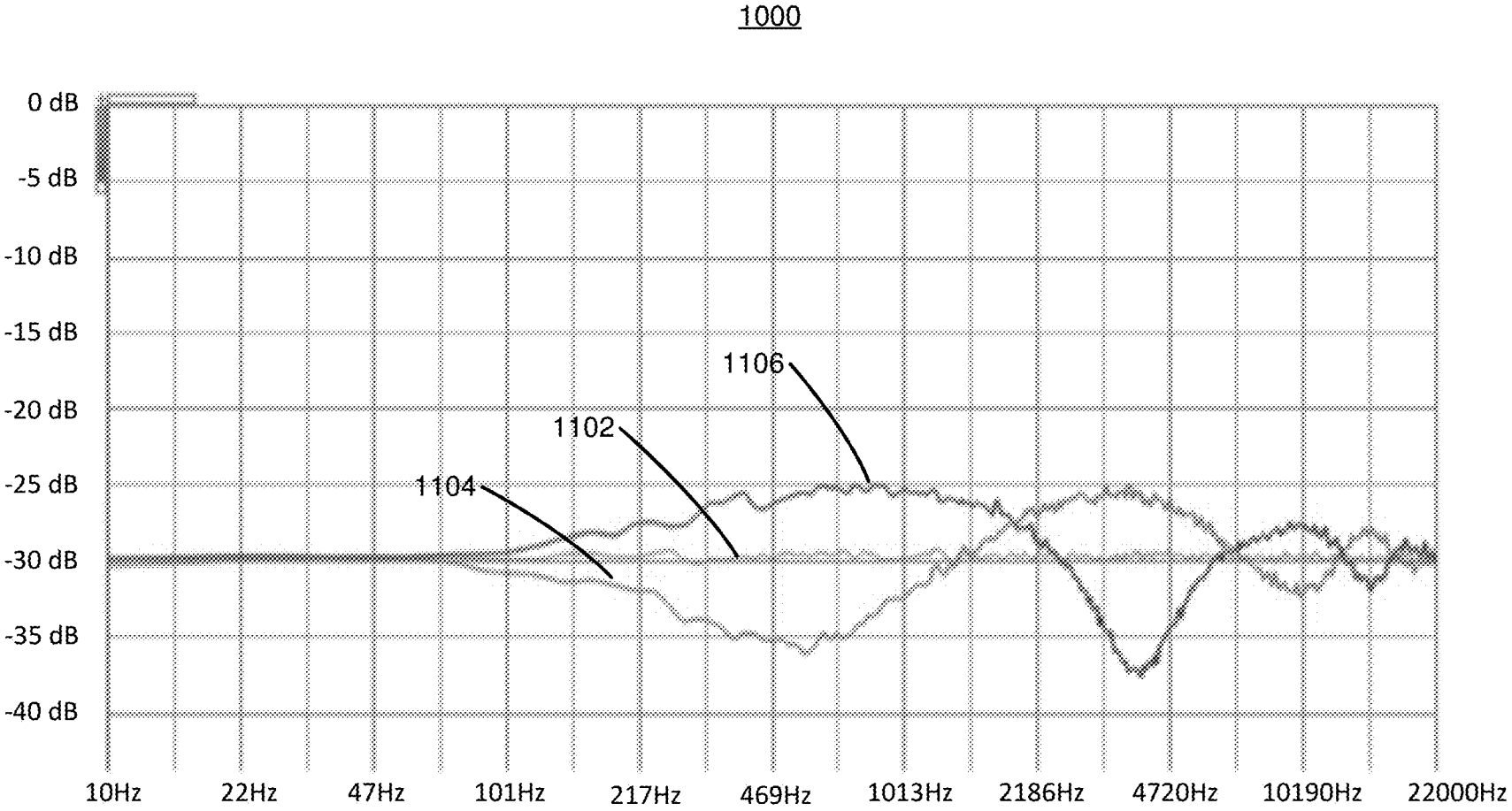
FIG. 10 illustrates a frequency plot of a crosstalk cancellation applied to mid and side channels, according to one embodiment.

FIG. 10 illustrates a frequency plot 1000 of a crosstalk cancellation applied to mid and side channels, according to one embodiment. The crosstalk cancellation shown in the plot 1000 differs from the crosstalk cancellation shown in the plots 600 and 800 in that a different speaker angle and crosschannel delays are used. In particular, for a speaker angle of 50 degrees and a small speaker setting, the crosstalk cancellation may include a crosstalk delay of 5 samples @48 KHz sampling rate, a crosstalk gain of −8.625 dB, and an in-band frequency range defined by a low frequency bypass of 350 Hz and a high frequency bypass of 12000 Hz. The line 1002 is a white noise input signal. The line 1004 is a mid channel of the input signal with crosstalk cancellation. The line 1006 is a side channel of the input signal with crosstalk cancellation.

Figure 11:
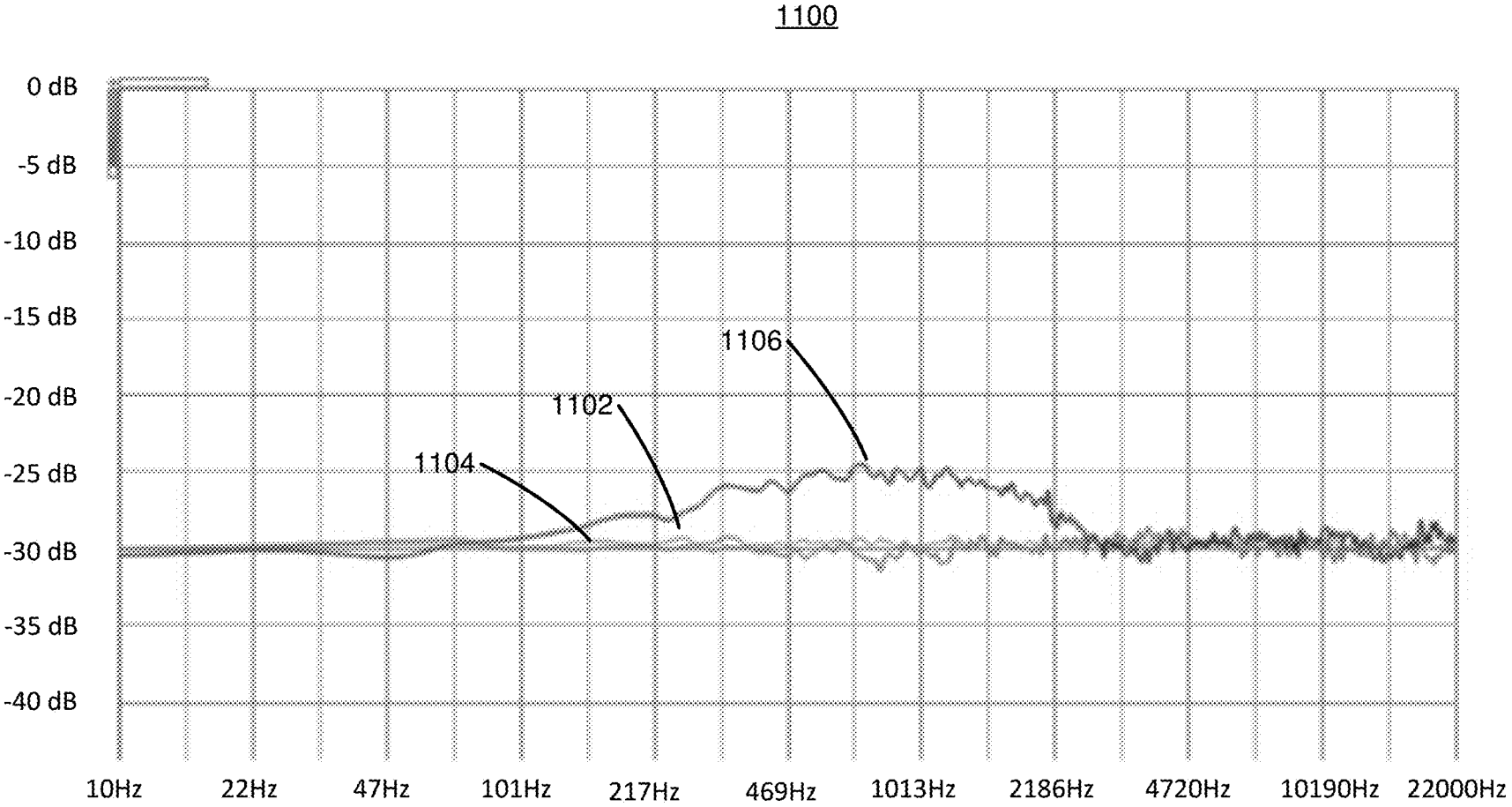
FIG. 11 illustrates a frequency plot for crosstalk cancellation and crosstalk compensation applied to a side channel, according to one embodiment.

FIG. 11 illustrates a frequency plot 1100 for crosstalk cancellation and crosstalk compensation applied to a side channel, according to one embodiment. The crosstalk cancellation shown in the plot 1100 uses similar parameters as the crosstalk cancellation shown in the plot 1000, but is applied only to the side channel. In particular, for the speaker angle of 50 degrees and the small speaker setting, the crosstalk cancellation may include the crosstalk delay of 5 samples @48 KHz sampling rate, the crosstalk gain of −8.625 dB, and the in-band frequency range defined by a low frequency bypass of 350 Hz and a high frequency bypass of 12000 Hz.

The line 1102 is a white noise input signal. The line 1104 is a mid channel of the input signal that bypasses the crosstalk cancellation and crosstalk compensation. The line 1106 is a side channel of the input signal after the crosstalk cancellation and crosstalk compensation. The crosstalk compensation results in the line 1106 being generated from the crosstalk canceled side channel shown by the line 1006 in the plot 1000. For the crosstalk compensation, three side filters are applied to the side channel including a first peaknotch filter having a 4,000 Hz center frequency, an 8.0 dB gain, and 2.0 Q, and a second peaknotch filter having an 8,800 Hz center frequency, a −2.0 dB gain, and 1.0 Q, and a third peaknotch filter having an 15,800 Hz center frequency, a 1.5 dB gain, and 2.5 Q. The number of side filters applied by the crosstalk compensation processor, as well as their parameters, may vary.

Example Processing

Figure 12:
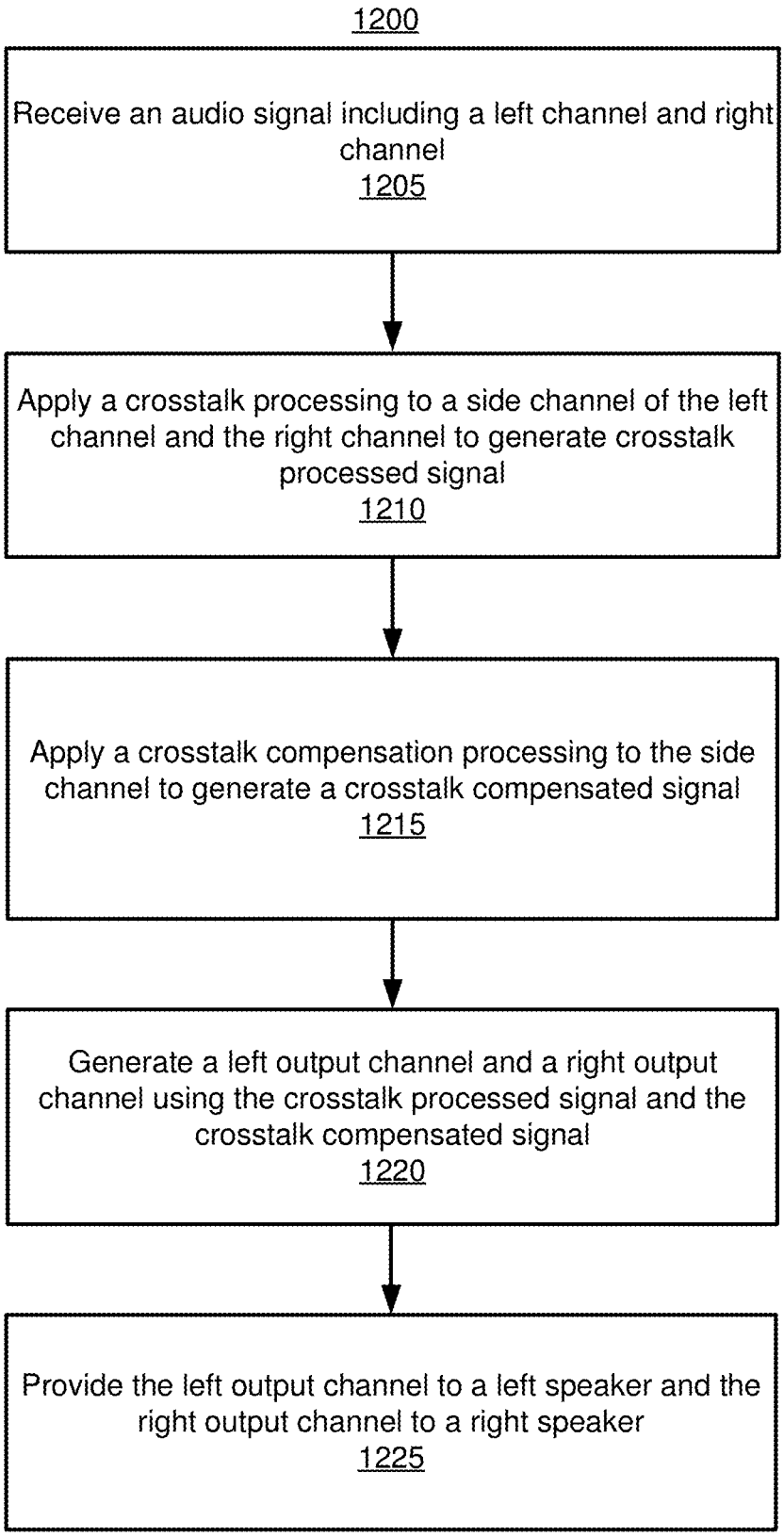
FIG. 12 illustrates a flowchart of a process for crosstalk processing and crosstalk compensation processing, according to one embodiment.

FIG. 12 illustrates a flowchart of a process 1200 for crosstalk processing and crosstalk compensation processing, according to one embodiment. The process 1200 may include fewer or additional steps, and steps may be performed in different orders.

An audio processing system receives 1205 an audio signal including a left channel and a right channel. The audio signal may be a stereo audio signal X with the left channel being mixed for a left speaker and the right channel being mixed for or a right speaker.

The audio processing system applies 1210 a crosstalk processing to a side channel of the left and right channels to generate a crosstalk processed signal. The crosstalk processing may include a crosstalk cancellation or a crosstalk simulation. A mid channel of the side channels may bypass the crosstalk processing.

For crosstalk cancellation, the audio processing system may include a crosstalk cancellation processor, such as the crosstalk cancellation processors 302, 304, 306, 308, 312, and 314 shown in FIGS. 3A, 3B, 3C, 3D, 3E, and 3F, respectively. These crosstalk cancellation processors operate in different ways to apply the crosstalk cancellation processing to the side channel while bypassing the mid channel. For example, the crosstalk cancellation processors 302, 304, and 306 each applies inverters and contralateral estimators to the left in-band channel $T_{L,In}$ and right in-band channel $T_{R,In}$ generated from the left and right channels, and then further processing as discussed above with reference to FIGS. 3A through 3C to result in the crosstalk cancellation processing being applied to the side channel, while bypassing the mid channel. In another example, the crosstalk cancellation processors 308, 312, and 314 each applies an inverter and contralateral estimator to the side in-band channel $T_{S,In}$ generated from the left and right channels, and then further processing as discussed above with reference to FIGS. 3D through 3F to result in the crosstalk cancellation processing being applied to the side channel, while bypassing the mid channel.

For crosstalk simulation, the audio processing system may include a crosstalk simulation processor, such as the crosstalk simulation processors 402, 404, 406, 408, 410, and 412 shown in FIGS. 4A, 4B, 4C, 4D, 4E, and 4F, respectively. These crosstalk simulation processors operate in different ways to apply the crosstalk simulation processing to the side channel of the left and right channels. For example, the crosstalk simulation processors 402, 404, and 406 each applies a low-pass filter, high-pass filter, crosstalk delay, and gain to each of the left channel $X_L$ and the right channel $X_R$, and then further processing as discussed above with reference to FIGS. 4A through 4C to result in the crosstalk simulation processing being applied to the side channel, while bypassing the mid channel. In another example, the crosstalk simulation processors 408, 410, and 412 each applies a low-pass filter, high-pass filter, crosstalk delay, and gain to a side channel $X_S$ generated from the left and right channels, and then further processing as discussed above with reference to FIGS. 4D through 4F to result in the crosstalk simulation processing being applied to the side channel, while bypassing the mid channel.

The audio processing system applies 1215 a crosstalk compensation processing to the side channel to generate a crosstalk compensated signal. The crosstalk compensation processing applied to the side channel adjusts for spectral defects caused by the crosstalk processing applied to the side channel. The mid channel may bypass the crosstalk compensation processing. The audio processing system may include the crosstalk compensation processor 500 as shown in FIG. 5. The crosstalk compensation processor 500 receives the output of crosstalk processing, shown as inputs $X_L$ and $X_R$ in FIG. 5, and generates the mid channel $X_M$ and the side channel $X_S$ from the channels $X_L$ and $X_R$. The side channel $X_S$ is processed by the side channel processor 530, while the mid channel $X_M$ bypasses this processing.

The audio processing system generates 1220 a left output channel and a right output channel using the crosstalk processed signal and the crosstalk compensated signal. The left and right output channels may also be generated using the mid channel that bypasses the crosstalk processing and crosstalk processing and crosstalk compensation processing. For example, the left output channel may be generated based on a sum of the result of the crosstalk processing and crosstalk compensation processing applied to the side channel and the mid channel that bypasses the crosstalk processing and crosstalk compensation processing. The right output channel may be generated based on a difference between the mid channel that bypasses the crosstalk processing and crosstalk compensation and the result of the crosstalk processing and crosstalk compensation processing applied to the side channel.

In some embodiments, each of the crosstalk processed signal and the crosstalk compensated signal may include a left and right channel, which may be used to respectively generate the left and right out channels. In some embodiments, the crosstalk compensation may be performed after the crosstalk processing as shown by the audio processing system 200 in FIG. 2A. Here, the crosstalk processed signal is used as input to the crosstalk compensation processing, and the output of the crosstalk compensation processing is used to generate the left output channel and a right output channel.

In some embodiments, the crosstalk processing and crosstalk compensation are performed in parallel, with their left output channels being combined (e.g., by the combiner 206) to generate the left output channel and their right output channels being combined to generate the right output channel, as shown by the audio processing system 210 in FIG. 2B.

In some embodiments, the crosstalk compensation is performed prior to the crosstalk cancellation, as shown by the audio processing system 214 in FIG. 2C. Here, the crosstalk compensated signal is used as input to the crosstalk processing, and the output of the crosstalk processing is used to generate the left output channel and the right output channel.

In some embodiments, the crosstalk compensation processing is not performed, and the left and right output channels of the crosstalk processing are used to generate the left output channel $O_L$ and the right output channel $O_R$, respectively.

The audio processing system provides 1225 the left output channel to a left speaker and the right output channel to a right speaker. If the crosstalk processing is crosstalk cancellation, the left and right speakers may be loudpseakers $\mathbf{110}_L$ and $\mathbf{110}_R$, respectively. If the crosstalk processing is crosstalk simulation, the left and right speakers may be headphones $\mathbf{130}_L$ and $\mathbf{130}_R$, respectively.

Example Computer

Figure 13:
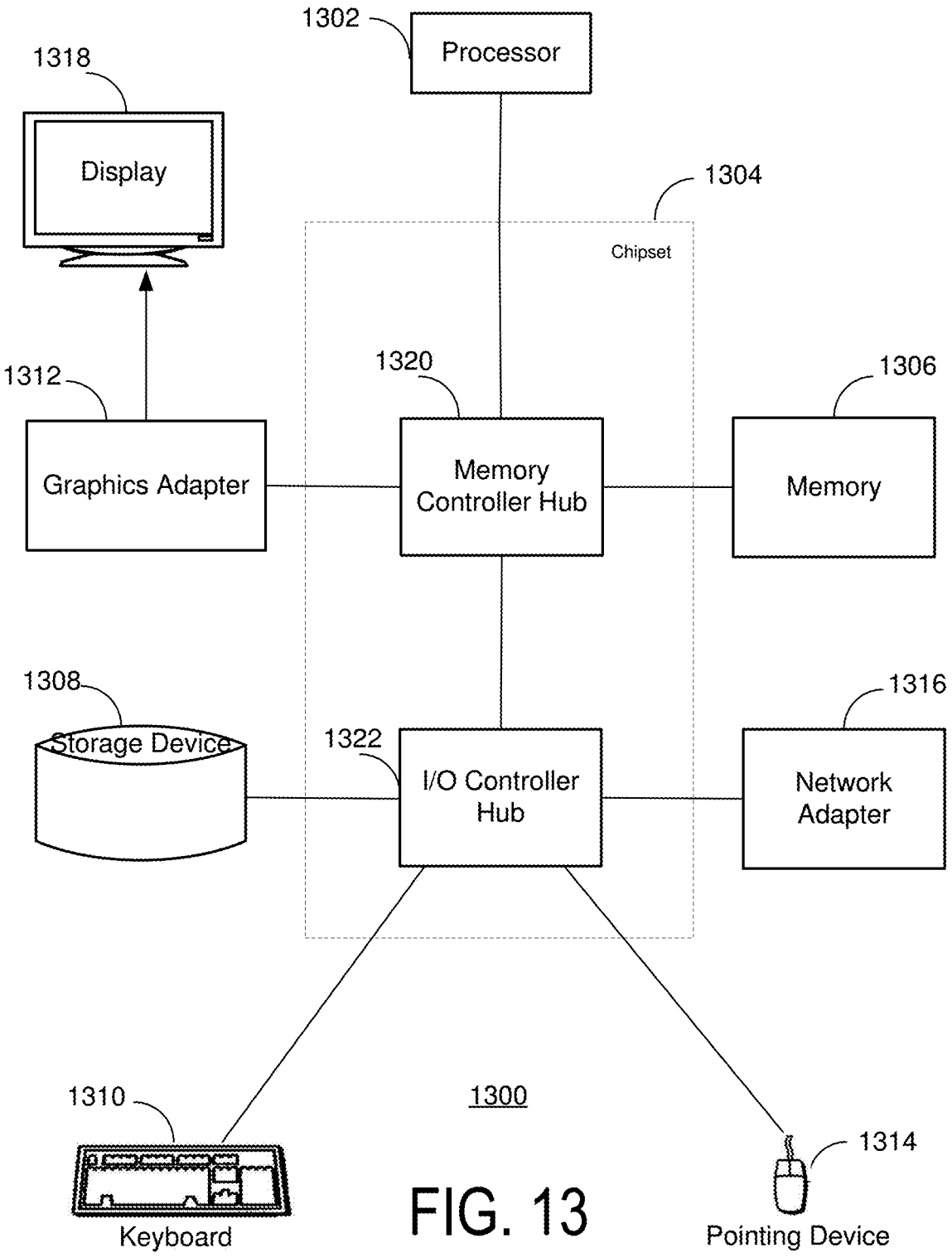
FIG. 13 illustrates a block diagram of a computer, according to one embodiment.

FIG. 13 illustrates a block diagram of a computer 1300, according to one embodiment. The computer 1300 is an example of circuitry that implements an audio system. Illustrated are at least one processor 1302 coupled to a chipset 1304. The chipset 1304 includes a memory controller hub 1320 and an input/output (I/O) controller hub 1322. A memory 1306 and a graphics adapter 1312 are coupled to the memory controller hub 1320, and a display device 1318 is coupled to the graphics adapter 1312. A storage device 1308, keyboard 1310, pointing device 1314, and network adapter 1316 are coupled to the I/O controller hub 1322. The computer 1300 may include various types of input or output devices. Other embodiments of the computer 1300 have different architectures. For example, the memory 1306 is directly coupled to the processor 1302 in some embodiments.

The storage device 1308 includes one or more non-transitory computer-readable storage media such as a hard drive, compact disk read-only memory (CD-ROM), DVD, or a solid-state memory device. The memory 1306 holds instructions and data used by the processor 1302. The pointing device 1314 is used in combination with the keyboard 1310 to input data into the computer system 1300. The graphics adapter 1312 displays images and other information on the display device 1318. In some embodiments, the display device 1318 includes a touch screen capability for receiving user input and selections. The network adapter 1316 couples the computer system 1300 to a network. Some embodiments of the computer 1300 have different and/or other components than those shown in FIG. 13.

The computer 1300 is adapted to execute computer program modules for providing functionality described herein. For example, some embodiments may include a computing device including one or more modules configured to perform the processing crosstalk processing or crosstalk cancellation processing as discussed herein. As used herein, the term "module" refers to computer program instructions and/or other logic used to provide the specified functionality. Thus, a module can be implemented in hardware, firmware, and/or software. In one embodiment, program modules formed of executable computer program instructions are stored on the storage device 1308, loaded into the memory 1306, and executed by the processor 1302.

Upon reading this disclosure, those of skill in the art will appreciate still additional alternative embodiments of the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A method for enhancing an audio signal having a left channel and a right channel, the method comprising:

applying crosstalk processing including a filter and a delay to a side channel of the left channel and the right channel to generate a crosstalk processed signal, the side channel including a difference between the left channel and the right channel, and a mid channel of the left channel and the right channel bypassing the crosstalk processing, the mid channel including a sum of the left channel and the right channel, wherein:

the crosstalk processing includes a crosstalk cancellation processing; and applying the crosstalk processing to the side channel of the left channel and the right channel to generate the crosstalk processed signal includes:

separating the left channel into a left in-band channel and a left out-of-band channel;

separating the right channel into a right in-band channel and a right out-of-band channel;

generating a side in-band channel based on a difference between the left in-band channel and the right in-band channel;

generating an inverted side in-band channel from the side in-band channel;

applying the filter and the delay to the inverted side in-band channel to generate a side contralateral cancellation channel;

generating a left crosstalk cancelled in-band channel based on a difference between the left in-band channel and the side contralateral cancellation channel;

generating a right crosstalk cancelled in-band channel based on a sum of the left in-band channel and the side contralateral cancellation channel;

generating a left crosstalk cancelled channel of the crosstalk processed signal by combining the left crosstalk cancelled in-band channel with the left out-of-band channel; and generating a right crosstalk cancelled channel of the crosstalk processed signal by combining the right crosstalk cancelled in-band channel with the right out-of-band channel; and generating a left output channel and a right output channel using the crosstalk processed signal and the mid channel that bypasses the crosstalk processing.

2. The method of claim 1, further comprising:

applying a second crosstalk processing to a second side channel of a second left channel and a second right channel to generate a second crosstalk processed signal by:

separating the second left channel into a second left in-band channel and a second left out-of-band channel;

separting the second right channel into a second right in-band channel and a second right out-of-band channel;

generating a second side in-band channel based on a difference between the second left in-band channel and the second right in-band channel;

generating a mid in-band channel based on a sum between the second left in-band channel and the second right in-band channel generating a second inverted side in-band channel from the second side in-band channel;

applying a second filter and a second delay to the second inverted side in-band channel to generate a second side contralateral cancellation channel;

generating a side crosstalk canceled in-band channel based on a difference between the second side in-band channel and the second side contralateral cancellation channel;

generating a second left crosstalk cancelled in-band channel based on a sum of the mid in-band channel and the side crosstalk canceled in-band channel;

generating a second right crosstalk cancelled in-band channel based on a difference between the mid in-band channel and the side crosstalk canceled in-band channel;

generating a second left crosstalk cancelled channel of the second crosstalk processed signal by combining the second left crosstalk cancelled in-band channel with the second left out-of-band channel; and generating a second right crosstalk cancelled channel of the second crosstalk processed signal by combining the second right crosstalk cancelled in-band channel with the second right out-of-band channel; and generating a second left output channel and a second right output channel using the second crosstalk processed signal and a second mid channel of the second left channel and the second right channel.

3. The method of claim 1, further comprising:

applying a second crosstalk processing to a second side channel of a second left channel and a second right channel to generate a second crosstalk processed signal by:

separating the second left channel into a second left in-band channel and a second left out-of-band channel;

separating the second right channel into a second right in-band channel and a second right out-of-band channel;

generating an inverted left in-band channel from the second left in-band channel;

generating an inverted right in-band channel from the second right in-band channel;

applying a second filter and a second delay to the inverted left in-band channel to generate a left contralateral cancellation channel;

applying a third filter and a third delay to the inverted right in-band channel to generate a right contralateral cancellation channel;

generating a second side contralateral cancellation channel based on a difference between the left contralateral cancellation channel and the right contralateral cancellation channel;

generating a second left crosstalk cancelled in-band channel based on a difference between the second left in-band channel and the second side contralateral cancellation channel;

generating a second right crosstalk cancelled in-band channel based on a sum of the second right in-band channel and the second side contralateral cancellation channel;

generating a second left crosstalk cancelled channel of the second crosstalk processed signal by combining the second left crosstalk cancelled in-band channel with the second left out-of-band channel; and generating a second right crosstalk cancelled channel of the second crosstalk processed signal by combining the second right crosstalk cancelled in-band channel with the second right out-of-band channel; and generating a second left output channel and a second right output channel using the second crosstalk processed signal and a second mid channel of the second left channel and the second right channel.

4. The method of claim 1, further comprising:

applying a second crosstalk processing to a second side channel of a second left channel and a second right channel to generate a second crosstalk processed signal by:

separating the second left channel into a second left in-band channel and a second left out-of-band channel;

separating the second right channel into a second right in-band channel and a second right out-of-band channel;

generating an inverted left in-band channel from the second left in-band channel;

generating an inverted right in-band channel from the second right in-band channel;

applying a second filter and a second delay to the inverted left in-band channel to generate a left contralateral cancellation channel;

applying a third filter and a third delay to the inverted right in-band channel to generate a right contralateral cancellation channel;

generating a second side contralateral cancellation channel based on a difference between the left contralateral cancellation channel and the right contralateral cancellation channel;

generating a left contralateral in-band channel based on a sum of the second side contralateral cancellation channel and a zero mid channel;

generating a right contralateral in-band channel based on a difference between the zero mid channel and the second side contralateral cancellation channel;

generating a second left crosstalk cancelled in-band channel based on a sum of the second left in-band channel and the right contralateral in-band channel;

generating a second right crosstalk cancelled in-band channel based on a sum of the left contralateral in-band channel and the second right in-band channel;

generating a second left crosstalk cancelled channel of the second crosstalk processed signal by combining the second left crosstalk cancelled in-band channel with the second left out-of-band channel; and generating a second right crosstalk cancelled channel of the second crosstalk processed signal by combining the second right crosstalk cancelled in-band channel with the second right out-of-band channel; and generating a second left output channel and a second right output channel using the second crosstalk processed signal and a second mid channel of the second left channel and second right channel.

5. The method of claim 1, further comprising:

applying a second crosstalk processing to a second side channel of a second left channel and a second right channel to generate a second crosstalk processed signal by:

separating the left channel into a left in-band channel and a left out-of-band channel;

separating the right channel into a right in-band channel and a right out-of-band channel;

generating an inverted left in-band channel from the second left in-band channel;

generating an inverted right in-band channel from the second right in-band channel;

applying a second filter and a second delay to the inverted left in-band channel to generate a left contralateral cancellation channel;

applying a third filter and a third delay to the inverted right in-band channel to generate a right contralateral cancellation channel;

generating a left in-band crosstalk channel based on a sum of the right contralateral cancellation channel and the second left in-band channel;

generating a right in-band crosstalk channel based on a sum of the left contralateral cancellation channel and the second right in-band channel;

generating a side in-band crosstalk channel based on a difference between the left in-band crosstalk channel and the right in-band crosstalk channel;

generating a mid in-band channel based on a sum of the second left in-band channel and the second right in-band channel;

generating a second left crosstalk cancelled in-band channel based on a sum of the mid in-band channel and the side in-band crosstalk channel;

generating a second right crosstalk cancelled in-band channel based on difference between the mid in-band channel and the side in-band crosstalk channel;

generating a second left crosstalk cancelled channel of the second crosstalk processed signal by combining the second left crosstalk cancelled in-band channel with the second left out-of-band channel; and generating a second right crosstalk cancelled channel of the second crosstalk processed signal by combining the second right crosstalk cancelled in-band channel with the second right out-of-band channel; and generating a second left output channel and a second right output channel using the second crosstalk processed signal and a second mid channel of the second left channel and second right channel.

6. A method for enhancing an audio signal having a left channel and a right channel, the method comprising:

applying crosstalk processing including a filter and a delay to a side channel of the left channel and the right channel to generate a crosstalk processed signal, the side channel including a difference between the left channel and the right channel, and a mid channel of the left channel and the right channel bypassing the crosstalk processing, the mid channel including a sum of the left channel and the right channel, wherein:

the crosstalk processing includes a crosstalk simulation processing; and applying the crosstalk processing to the side channel of the left channel and the right channel to generate the crosstalk processed signal includes:

generating the side channel based on a difference between the left channel and the right channel generating a side crosstalk simulation channel by applying the filter and the delay to the side channel;

generating a left crosstalk simulation channel based on a sum of the side crosstalk simulation channel and a zero mid channel;

generating a right crosstalk simulation channel based on a difference between the zero mid channel and the side crosstalk simulation channel;

generating a left crosstalk simulated channel of the crosstalk processed signal based on a sum of the left channel and the right crosstalk simulation channel; and generating a right crosstalk simulated channel of the crosstalk processed signal based on a sum of the right channel and the left crosstalk simulation channel; and generating a left output channel and a right output channel using the crosstalk processed signal and the mid channel that bypasses the crosstalk processing.

7. The method of claim 6, further comprising:

applying a second crosstalk processing to a second side channel of a second left channel and a second right channel to generate a second crosstalk processed signal by:

generating the second side channel based on a difference between the second left channel and the second right channel;

generating a second side crosstalk simulation channel by applying a second filter and a second delay to the second side channel;

generating a second left crosstalk simulated channel of the second crosstalk processed signal based on a difference between the second left channel and the second side crosstalk simulation channel; and generating a second right crosstalk simulated channel of the second crosstalk processed signal based on a sum of the second right channel and the second side crosstalk simulation channel; and generating a second left output channel and a second right output channel using the second crosstalk processed signal and a second mid channel of the second left channel and the second right channel.

8. The method of claim 6, further comprising:

applying a second crosstalk processing to a second side channel of a second left channel and a second right channel to generate a second crosstalk processed signal by:

generating the second side channel based on the difference between the second left channel and the second right channel;

generating a second mid channel based on the sum of the second left channel and the second right channel;

generating a second side crosstalk simulation channel by applying a second filter and a second delay to the side channel;

generating a side crosstalk channel based on a difference between the second side channel and the second side crosstalk simulation channel;

generating a second left crosstalk simulated channel of the second crosstalk processed signal based on a sum of the second mid channel and the side crosstalk channel; and generating a second right crosstalk simulated channel of the second crosstalk processed signal based on a difference between the second mid channel and the side crosstalk channel; and generating a second left output channel and a second right output channel using the second crosstalk processed signal and the second mid channel.

9. The method of claim 6, further comprising:

applying a second crosstalk processing to a second side channel of a second left channel and a second right channel to generate a second crosstalk processed signal by:

generating a second left crosstalk simulation channel by applying a second filter and a second delay to the second left channel;

generating a second right crosstalk simulation channel by applying a third filter and a third delay to the second right channel;

generating a second side crosstalk simulation channel based on a difference between the the second left crosstalk simulation channel and the second right crosstalk simulation channel;

generating a second left crosstalk simulated channel of the second crosstalk processed signal based on a difference between the second left channel and the second side crosstalk simulation channel; and generating a second right crosstalk simulated channel of the second crosstalk processed signal based on a sum of the second right channel and the second side crosstalk simulation channel; and generating a second left output channel and a second right output channel using the second crosstalk processed signal and a second mid channel of the second left channel and the second right channel.

10. The method of claim 6, further comprising:

applying a second crosstalk processing to a second side channel of a second left channel and a second right channel to generate a second crosstalk processed signal by:

generating a second left crosstalk simulation channel by applying a second filter and a second delay to the second left channel;

generating a second right crosstalk simulation channel by applying a third filter and a third delay to the second right channel;

generating a second side crosstalk simulation channel based on a difference between the second left crosstalk simulation channel and the second right crosstalk simulation channel;

generating a left crosstalk channel based on a sum of the second side crosstalk simulation channel and a zero mid channel;

generating a right crosstalk channel based on a difference between the zero mid channel and the second side crosstalk simulation channel;

generating a second left crosstalk simulated channel of the second crosstalk processed signal based on a sum of the second left channel and the right crosstalk channel; and generating a second right crosstalk simulated channel of the second crosstalk processed signal based on a sum of the second right channel and the left crosstalk channel; and generating a second left output channel and a second right output channel using the second crosstalk processed signal and a second mid channel of the second left channel and the second right channel.

11. The method of claim 6, further comprising:

applying a second crosstalk processing to a second side channel of a second left channel and a second right channel to generate a second crosstalk processed signal by:

generating a second mid channel based on a sum of the second left channel and the second right channel;

generating a second left crosstalk simulation channel by applying a second filter and a second delay to the left channel;

generating a second right crosstalk simulation channel by applying a third filter and a third delay to the right channel;

generating a left crosstalk channel based on a sum of the second left channel and the second right crosstalk simulation channel;

generating a right crosstalk channel based on a sum of the second right channel and the secoond left crosstalk simulation channel;

generating a side crosstalk channel based on a difference between the left crosstalk channel and the right crosstalk channel;

generating a second left crosstalk simulated channel of the second crosstalk processed signal based a sum of the side crosstalk channel and the second mid channel; and generating a second right crosstalk simulated channel of the second crosstalk processed signal based on a difference between the second mid channel and the side crosstalk channel; and generating a second left output channel and a second right output channel using the second crosstalk processed signal and the second mid channel.

12. The method of claim 1, further comprising applying crosstalk compensation processing to the side channel to generate a crosstalk compensated signal, the crosstalk compensation processing adjusting for spectral defects caused by the crosstalk processing, the mid channel bypassing the crosstalk compensation processing.

13. The method of claim 12, wherein applying the crosstalk compensation processing to the side channel to generate the crosstalk compensated signal includes:

generating a side crosstalk compensation channel by applying a second filter to the side channel;

generating a left crosstalk compensated channel of the crosstalk compensated signal based on a sum of the mid channel and the side crosstalk compensation channel; and generating a right crosstalk compensated channel of the crosstalk compensated signal based on a difference between the mid channel and the side crosstalk compensation channel.

14. The method of claim 12, wherein the crosstalk compensation processing is applied to the side channel subsequent to the crosstalk processing being applied to the side channel.

15. The method of claim 12, wherein the crosstalk compensation processing is applied to the side channel prior to the crosstalk processing being applied to the side channel.

16. The method of claim 12, wherein the crosstalk compensation processing is applied to the side channel in parallel with the crosstalk processing being applied to the side channel.

17. A non-transitory computer readable medium storing program code that when executed by a processor causes the processor to:

apply crosstalk processing including a filter and a delay to a side channel of a left channel and a right channel of an audio signal to generate a crosstalk processed signal, the side channel including a difference between the left channel and the right channel, a mid channel of the left channel and the right channel bypassing the crosstalk processing, the mid channel including a sum of the left channel and the right channel; wherein:

the crosstalk processing includes a crosstalk cancellation processing; and the program code causes the processor to apply the crosstalk processing to the side channel of the left channel and the right channel to generate the crosstalk processed signal by:

separating the left channel into a left in-band channel and a left out-of-band channel;

separating the right channel into a right in-band channel and a right out-of-band channel;

generating a side in-band channel based on a difference between the left in-band channel and the right in-band channel;

generating an inverted side in-band channel from the side in-band channel;

applying the filter and the delay to the inverted side in-band channel to generate a side contralateral cancellation channel;

generating a left crosstalk cancelled in-band channel based on a difference between the left in-band channel and the side contralateral cancellation channel;

generating a right crosstalk cancelled in-band channel based on a sum of the left in-band channel and the side contralateral cancellation channel;

generating a left crosstalk cancelled channel of the crosstalk processed signal by combining the left crosstalk cancelled in-band channel with the left out-of-band channel; and generating a right crosstalk cancelled channel of the crosstalk processed signal by combining the right crosstalk cancelled in-band channel with the right out-of-band channel; and generate a left output channel and a right output channel using the crosstalk processed signal and the mid channel that bypasses the crosstalk processing.

18. A system for enhancing an audio signal having a left channel and a right channel, comprising:

circuitry configured to:

apply crosstalk processing including a filter and a delay to a side channel of the left channel and the right channel to generate a crosstalk processed signal, the side channel including a difference between the left channel and the right channel, a mid channel of the left channel and the right channel bypassing the crosstalk processing, the mid channel including a sum of the left channel and the right channel; wherein:

the crosstalk processing includes a crosstalk cancellation processing; and the circuitry is configured to apply the crosstalk processing to the side channel of the left channel and the right channel to generate the crosstalk processed signal by:

separating the left channel into a left in-band channel and a left out-of-band channel;

separating the right channel into a right in-band channel and a right out-of-band channel;

generating a side in-band channel based on a difference between the left in-band channel and the right in-band channel;

generating an inverted side in-band channel from the side in-band channel;

applying the filter and the delay to the inverted side in-band channel to generate a side contralateral cancellation channel;

generating a left crosstalk cancelled in-band channel based on a difference between the left in-band channel and the side contralateral cancellation channel;

generating a right crosstalk cancelled in-band channel based on a sum of the left in-band channel and the side contralateral cancellation channel;

generating a left crosstalk cancelled channel of the crosstalk processed signal by combining the left crosstalk cancelled in-band channel with the left out-of-band channel; and generating a right crosstalk cancelled channel of the crosstalk processed signal by combining the right crosstalk cancelled in-band channel with the right out-of-band channel; and generate a left output channel and a right output channel using the crosstalk processed signal and the mid channel that bypasses the crosstalk processing.

19. The method of claim 1, further comprising:

applying a second crosstalk processing to a second side channel of a second left channel and a second right channel to generate a second crosstalk processed signal by:

separating the second left channel into a second left in-band channel and a second left out-of-band channel;

separating the second right channel into a second right in-band channel and a second right out-of-band channel;

generating a second in-band channel of the side component based on a difference between the second left in-band channel and the second right in-band channel;

generating a second inverted side in-band channel from the second side in-band channel;

applying a second filter and a second delay to the second inverted side in-band channel to generate a second side contralateral cancellation channel;

generating a left contralateral in-band channel based on a sum of a zero mid channel and the second side contralateral cancellation channel;

generating a right contralateral in-band channel based on a difference between the zero mid channel and the second side contralateral cancellation channel;

generating a second left crosstalk cancelled in-band channel based on a sum of the right contralateral in-band channel and the second left in-band channel;

generating a second right crosstalk cancelled in-band channel based on a sum of the left contralateral in-band channel and the second right in-band channel;

generating a second left crosstalk cancelled channel of the second crosstalk processed signal by combining the second left crosstalk cancelled in-band channel with the second left out-of-band channel; and generating a second right crosstalk cancelled channel of the second crosstalk processed signal by combining the second right crosstalk cancelled in-band channel with the seocnd right out-of-band channel; and generating a second left output channel and a second right output channel using the second crosstalk processed signal and a second mid channel of the second left channel and the second right channel.

* * * * *